US006355390B1

(12) United States Patent
Yamanami et al.

(10) Patent No.: US 6,355,390 B1
(45) Date of Patent: Mar. 12, 2002

(54) ELECTROPHOTOGRAPHIC PHOTOCONDUCTOR, PRODUCTION PROCESS THEREOF, ELECTROPHOTOGRAPHIC IMAGE FORMING METHOD AND APPARATUS, AND PROCESS CARTRIDGE

(75) Inventors: Hirofumi Yamanami; Tamotsu Aruga, both of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/633,361

(22) Filed: Aug. 4, 2000

(30) Foreign Application Priority Data

| | | |
|---|---|---|
| Aug. 6, 1999 | (JP) | 11-223210 |
| Nov. 24, 1999 | (JP) | 11-333108 |
| Apr. 14, 2000 | (JP) | 12-113299 |

(51) Int. Cl.[7] ..... G03G 5/14

(52) U.S. Cl. ..... 430/60; 430/62; 430/100; 430/131; 399/130

(58) Field of Search ..... 430/60, 62, 65, 430/131, 100; 399/130

(56) References Cited

U.S. PATENT DOCUMENTS

| | | | | |
|---|---|---|---|---|
| 5,762,743 A | * | 6/1998 | Nakamura | 156/235 |
| 5,972,550 A | * | 10/1999 | Tamura et al. | 430/65 |

FOREIGN PATENT DOCUMENTS

| | | |
|---|---|---|
| JP | 61-36755 | 2/1986 |
| JP | 61-204642 | 9/1986 |
| JP | 62-280864 | 12/1987 |
| JP | 63-289554 | 11/1988 |
| JP | 64-31163 | 2/1989 |
| JP | 2-108064 | 4/1990 |
| JP | 5-150535 | 6/1993 |
| JP | 6-202366 | 7/1994 |
| JP | 9-269606 | 10/1997 |
| JP | 9-288367 | 11/1997 |
| JP | 2785282 | 5/1998 |
| JP | 2817421 | 8/1998 |
| JP | 10-268543 | 10/1998 |
| JP | 2861557 | 12/1998 |
| JP | 2885609 | 2/1999 |

* cited by examiner

*Primary Examiner*—John Goodrow
(74) *Attorney, Agent, or Firm*—Oblon, Spivak, McClelland, Maier & Neustadt, P.C.

(57) ABSTRACT

An electrophotographic photoconductor has an electroconductive support, and an undercoat layer and a photoconductive layer which are successively overlaid on the support, the undercoat layer containing an inorganic pigment and a crosslinked N-alkoxymethylated polyamide or a crosslinked material of an N-alkoxymethylated polyamide and a melamine resin as a binder resin. The method of producing the photoconductor is also disclosed. An electrophotographic image forming apparatus is provided with the aforementioned photoconductor, a charging unit, and a developing unit. A process cartridge is provided with the photoconductor, and at least one of a charging unit, a light exposure unit, a developing unit, or an image transfer unit. An electrophotographic image forming process has the steps of forming a latent electrostatic image on the photoconductor, and developing the latent electrostatic image to a visible image by reversal development.

33 Claims, 1 Drawing Sheet

ELECTROPHOTOGRAPHIC PHOTOCONDUCTOR, PRODUCTION PROCESS THEREOF, ELECTROPHOTOGRAPHIC IMAGE FORMING METHOD AND APPARATUS, AND PROCESS CARTRIDGE

BACKGROUND OF THE INVENTION

1. Field of the Invention

The present invention relates to an electrophotographic photoconductor for use in a laser beam printer, facsimile machine, and digital copier, which photoconductor comprises an electroconductive support, and an undercoat layer and a photoconductive layer successively overlaid on the support in this order. In addition, the present invention relates to a production process of the above-mentioned photoconductor, an electrophotographic image forming method and apparatus using the above-mentioned photoconductor. Further, the present invention also relates to a process cartridge holding therein the above-mentioned photoconductor, which process cartridge is freely attachable to the image forming apparatus and detachable therefrom.

2. Discussion of Background

Basically, an electrophotographic photoconductor comprises an electroconductive support and a photoconductive layer formed thereon comprising a photoconductive material. Further, it is proposed to provide an undercoat layer between the electroconductive support and the photoconductive layer for the following purposes: improving the adhesion of the photoconductive layer to the support, the coating characteristics of the photoconductive layer, the charging characteristics of the photoconductive layer, inhibiting unnecessary charges from injecting from the support into the photoconductive layer, and compensating for any defects on the support.

Methoxymethylated polyamide is conventionally known as a well-balanced material for the undercoat layer as disclosed in Japanese Laid-Open Patent Application 6-202366. However, an N-alkoxymethylated polyamide represented by the above-mentioned methoxymethylated polyamide exhibits high water absorption properties because of the presence of an alkoxyl group in the structure. In the case where a photoconductor comprises an undercoat layer comprising such an N-alkoxymethylated polyamide, the photoconductor properties are largely changed in the repeated use under the circumstances of high temperature and humidity, or low temperature and humidity. Such a drawback results from the increase of water content in the undercoat layer. The above-mentioned photoconductor tends to produce abnormal images with toner deposition on the background and low image density.

In Japanese Laid-Open Patent Application Nos. 2-108064 and 10-268543, and Japanese Patent Nos. 2817421 and 2785282, an undercoat layer for use in the photoconductor consists of a crosslinked methoxymethylated polyamide. However, the photoconductor properties are still dependent on environmental conditions because of insufficient crosslinking in the methoxymethylated polyamide. Further, in this case, the problem of the increase in residual potential is caused when the undercoat layer is thickened. More specifically, the surface of the electrophotographic photoconductor is charged, and exposed to light images according to the electrophotographic process. The light-exposed portion of the photoconductor is made electroconductive, and electric charges can transfer in the photoconductor. Image data can be thus recorded in the form of latent electrostatic images. When the thickness of the undercoat layer exceeds 1.0 $\mu$m, the electric charge on the light-exposed portion unfavorably remains on the photoconductor, and the residual potential is increased in the repeated use of the photoconductor. The increase in residual potential, which means a deterioration of the photoconductor, will produce abnormal images.

To solve the above-mentioned problem, it is required that the thickness of the undercoat layer be decreased to 1.0 $\mu$m or less when the undercoat layer consists of methoxymethylated polyamide alone. However, a thin undercoat layer cannot effectively make up for the defects on the electroconductive support, such as scratches and surface roughness. To regulate the surface properties of the electroconductive support, the surface treatment steps of cutting and abrasion become necessary, thereby increasing the manufacturing cost of the photoconductor.

In addition, when a photoconductor with a thin undercoat layer is set in an electrophotographic image forming apparatus where a contact type charger is installed, discharge breakdown occurs in the photoconductor, with the result that abnormal images are easily produced. In particular, when the process of reversal development is adapted, the above-mentioned discharge breakdown produces a relatively large black spot image. This is conventionally regarded as a serious problem.

To eliminate the problem caused by the water absorption properties of methoxymethylated polyamide, it is proposed to add a thermosetting resin such as melamine resin to the methoxymethylated polyamide in Japanese Laid-Open Patent Application No. 3-337861 and Japanese Patent No. 2861557. The aforementioned undercoat layer comprising the methoxymethylated polyamide and the melamine resin can solve the problem resulting from the water absorption properties to some extent. However, there still remains the problem that the physical properties of the methoxymethylated polyamide are practically dependent upon temperature and humidity. Therefore, even though the photoconductive layer is provided on such an undercoat layer, the photoconductor properties are still susceptible to temperature and humidity. The result is that abnormal images such as black spots are produced and the image density is lowered when image formation is repeated under the circumstances of high temperature and humidity or low temperature and humidity.

According to Japanese Laid-Open Patent Application No. 5-150535 and Japanese Patent No. 2861557, an undercoat layer for use in the electrophotographic photoconductor comprises (i) a thermosetting resin and (ii) a thermoplastic resin such as a modified polyamide resin which comprises as the main component a copolymer polyamide comprising a modified polyamide 6 or polyamide 6. When such a photoconductor is operated under the circumstances of low temperature and humidity, the residual potential (VL) of a light-exposed portion tends to largely vary and produces abnormal images.

As disclosed in Japanese Laid-Open Patent Application Nos. 61-204642 and 62-280864, it is well known that an inorganic pigment such as titanium oxide is dispersed in the undercoat layer to effectively compensate for the defects on the surface of the electroconductive support and to enhance the light scattering effect of coherent light such as a laser beam and prevent the interference fringes. Such an undercoat layer comprising an inorganic pigment causes no problem in the initial stage. However, when the photoconductor is set in an electrophotographic image forming apparatus and repeatedly used for an extended period of time, defective images such as toner deposition on the background and non-printed white spots in a solid image become conspicuous with time.

To eliminate the defective images produced in the repeated use, there is proposed in Japanese Laid-Open. Patent Application Nos. 63-289554 and 64-031163 an electrophotographic photoconductor comprising an electroconductive support, and a first undercoat layer containing no filler, a second undercoat layer in which an inorganic pigment is dispersed, and a photoconductive layer which are successively overlaid on the electroconductive support. However, such a layered undercoat layer cannot solve the above-mentioned problem. Namely, occurrence of abnormal images cannot be prevented when the photoconductor is used for an extended period of time.

In Japanese Laid-Open Patent Application No. 6-202366 and Japanese Patent No. 2885609, it is proposed to provide an undercoat layer using a coating liquid prepared by dissolving and dispersing non-electroconductive titanium oxide particles and a polyamide resin in a mixed solvent of an alcohol and a particular organic solvent. However, the water absorption properties of the obtained undercoat layer are so high that the photoconductor properties are largely dependent upon environmental conditions. Therefore, black spots will appear and the image density will be lowered in the repeated use of the photoconductor under the circumstances of high temperature and humidity or low temperature and humidity, as mentioned above.

A photoconductor disclosed in Japanese Laid-Open Patent Application 61-036755 comprises a first undercoat layer in which titanium oxide particles coated with a layer comprising $Sb_2O_3$ and $SnO_2$ are dispersed and a second undercoat layer consisting of a resin component, the first and second undercoat layers being successively overlaid on the support in this order. However, the overall requirements of the photoconductor, for example, the charging characteristics, sensitivity, and image quality are not satisfied.

In Japanese Laid-Open Patent Application 9-288367, a first undercoat layer comprising a thermosetting resin and an inorganic pigment dispersed therein and a second undercoat layer comprising a polyamide resin are interposed between the electroconductive support and the photoconductive layer. By the provision of the second undercoat layer comprising a polyamide resin, abnormal images can be inhibited from occurring even after the photoconductor is repeatedly used. However, the increase in residual potential of a light-exposed portion is noticeable while in practical use under the circumstances of low temperature and humidity. The potential of the light-exposed portion tends to increase with the increase of the residual potential, and this tendency becomes striking as the photoconductor is caused to deteriorate.

By the way, to carry out the crosslinking of an N-alkoxymethylated polyamide and a melamine resin at a practical temperature, both are dissolved in a solvent to prepare a resin solution, and the resultant solution is made acid and heated. However, when titanium oxide particles are dispersed in the resin solution to which an acid catalyst is added, the obtained dispersion is so unstable that the pot life of the dispersion is short. In such a dispersion, inorganic pigment particles such as titanium oxide particles tend to aggregate to form large number of agglomerates. When an undercoat layer is provided on the electroconductive support using such a dispersion as a coating liquid for undercoat layer, the surface of the obtained undercoat layer cannot be made even because of the presence of the above-mentioned coarse particles of agglomerates. The defects on the electroconductive support cannot be made up for by the provision of the undercoat layer as a matter of course, and the photoconductive layer cannot be uniformly provided on the undercoat layer. As a result, the photoconductor will produce abnormal images such as black spots and images with a low image density because the photoconductor properties are uneven. To solve the above-mentioned problem in the course of the production of the photoconductor, it is required that the coating liquid for undercoat layer be frequently replaced with a new one, whereby the manufacturing cost necessarily increases.

An undercoat layer disclosed in Japanese Laid-Open Patent Application 9-269606 comprises a crosslinked material of methoxymethylated polyamide resin and a melamine resin, and surface-treated titanium oxide particles dispersed in the crosslinked material. In this application, the surface-treated titanium oxide particles are used to improve the dispersion stability of titanium oxide particles in the resin solution. However, the use of such surface-treated titanium oxide particles readily increases the residual potential of the photoconductor after the repeated use. To solve the problem of increase in residual potential, the undercoat layer is required to be extremely thin. In the case where the undercoat layer is extremely thin, the step of regulating the surface properties of the electroconductive support becomes necessary, and abnormal images are easily produced because discharge breakdown occurs in the photoconductor. Further, by the influence of the surface treatment to which titanium oxide particles are subjected, the photoconductor properties are largely dependent upon environmental conditions.

SUMMARY OF THE INVENTION

In view of the above-mentioned conventional drawbacks, it is a first object of the present invention to provide an electrophotographic photoconductor with high durability, capable of constantly producing high quality images even though the photoconductor is repeatedly used under the circumstances of high temperature and humidity or low temperature and humidity.

A second object of the present invention is to provide an electrophotographic photoconductor free from the occurrence of discharge breakdown, and the increase in residual potential.

A third object of the present invention is to provide an electrophotographic photoconductor which can be manufactured at low cost.

A fourth object of the present invention is to provide a production process of the above-mentioned electrophotographic photoconductor.

A fifth object of the present invention is to provide an electrophotographic image forming apparatus employing the above-mentioned electrophotographic photoconductor.

A sixth object of the present invention is to provide an electrophotographic image forming method employing the above-mentioned electrophotographic photoconductor.

A seventh object of the present invention is to provide a process cartridge holding therein the above-mentioned electrophotographic photoconductor.

The aforementioned first to third objects of the present invention can be achieved by an electrophotographic photoconductor comprising an electroconductive support, an undercoat layer formed thereon, and a photoconductive layer formed on the undercoat layer, the undercoat layer comprising (a) an inorganic pigment and (b) a binder resin which is selected from the group consisting of a crosslinked N-alkoxymethylated polyamide and a crosslinked material of an N-alkoxymethylated polyamide and a melamine resin.

The undercoat layer may comprise a first undercoat layer and a second undercoat layer which are successively overlaid on the electroconductive support in this order. In this case, the first undercoat layer comprises a thermosetting resin and the above-mentioned inorganic pigment dispersed in the thermosetting resin, and the second undercoat layer comprises the binder resin selected from the group consisting of the crosslinked N-alkoxymethylated polyamide and the crosslinked material of the N-alkoxymethylated polyamide and the melamine resin.

The above-mentioned fourth object of the present invention can be achieved by a method for producing an electrophotographic photoconductor comprising the steps of applying a coating liquid for undercoat layer comprising (a) an inorganic pigment and (b) a binder resin which is selected from the group consisting of an N-alkoxymethylated polyamide and a mixture of an N-alkoxymethylated polyamide and a melamine resin to an electroconductive support to form a coated film thereon, heating the coated film to crosslink the N-alkoxymethylated polyamide or the mixture of N-alkoxymethylated polyamide and melamine resin, thereby providing an undercoat layer on the electroconductive support, and providing a photoconductive layer on the undercoat layer.

In the case where the undercoat layer comprises the first and second undercoat layers, a method for producing the electrophotographic photoconductor comprises the steps of providing on an electroconductive support a first undercoat layer which comprises a thermosetting resin and an inorganic pigment dispersed in the thermosetting resin, applying a coating liquid for second undercoat layer comprising a binder resin which is selected from the group consisting of an N-alkoxymethylated polyamide and a mixture of an N-alkoxymethylated polyamide and a melamine resin to the first undercoat layer to form a coated film thereon, heating the coated film to crosslink the N-alkoxymethylated polyamide or the mixture of N-alkoxymethylated polyamide and melamine resin, thereby providing a second undercoat layer on the first undercoat layer, and providing a photoconductive layer on the second undercoat layer.

The fifth object of the present invention can be achieved by an electrophotographic image forming apparatus comprising the above-mentioned electrophotographic photoconductor, means for charging the electrophotographic photoconductor for forming a latent electrostatic image thereon, and means for developing the latent electrostatic image formed on the electrophotographic photoconductor to a visible image.

The sixth object of the present invention can be achieved by an electrophotographic image forming process comprising the steps of forming a latent electrostatic image on the surface of the above-mentioned electrophotographic photoconductor, and developing the latent electrostatic image to a visible image by reversal development.

The seventh object of the present invention can be achieved by a process cartridge which can be freely attachable to an electrophotographic image forming apparatus and detachable therefrom, the process cartridge comprising the above-mentioned electrophotographic photoconductor, and at least one of a charging means for charging the surface of the photoconductor, a light exposure means for exposing the photoconductor to a light image to form a latent electrostatic image on the photoconductor, a developing means for developing the latent electrostatic image to a visible image, or an image transfer means for transferring the visible image formed on the photoconductor to an image receiving member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
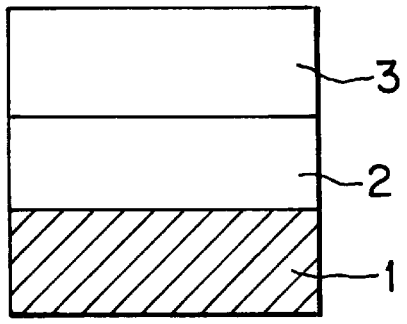
FIG. 1 is a schematic cross-sectional view which shows the first embodiment of an electrophotographic photoconductor according to the present invention.

In the electrophotographic photoconductor of the present invention, the undercoat layer comprises an inorganic pigment and a binder resin. The binder resin is a crosslinked N-alkoxymethylated polyamide or a a crosslinked material of an N-alkoxymethylated polyamide and a melamine resin.

It is conventionally known that the N-alkoxymethylated polyamide causes a crosslinking reaction by the application of heat thereto. For instance, the crosslinking reaction scheme of methoxymethylated polyamide is shown below.

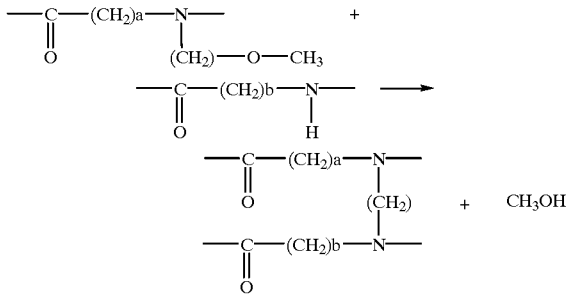

As is apparent from the above reaction scheme, the number of methoxy groups in the N-methoxymethylated polyamide compound is decreased by dealkoxylation accompanied by the crosslinking reaction, and the crosslinked methoxymethylated polyamide shows a three-dimensional network structure. The water absorption properties of the crosslinked N-alkoxymethylated polyamide are weakened because the number of alkoxyl groups is decreased. When the above-mentioned crosslinked N-alkoxymethylated polyamide is employed for the undercoat layer, the photoconductor properties of the obtained photoconductor are less dependent upon ambient temperature and humidity. Likewise, the crosslinked material of an N-alkoxymethylated polyamide and a melamine resin has a three-dimensional network structure, so that the temperature and humidity dependent properties of the photoconductor properties can be diminished.

If an undercoat layer consists of the above-mentioned crosslinked N-alkoxymethylated polyamide alone, and has a certain thickness, the residual potential of a light-exposed portion of the photoconductor tends to gradually increase, which causes the occurrence of abnormal images. To solve this problem, in the present invention, the inorganic pigment is dispersed in the crosslinked structure of the resin in the undercoat layer. The presence of the inorganic pigment can prevent the residual potential from increasing, whereby the thickness of the undercoat layer can be increased to some extent. By providing such an undercoat layer, the obtained photoconductor does not readily deteriorate even after repeatedly used. In addition, since the undercoat layer is relatively thick, the undercoat layer can be prevented from causing discharge breakdown even though the photoconductor is charged by a contact-type charging method. Therefore, when the photoconductor of the present invention is set in an electrophotographic image forming apparatus, it is possible to minimize the occurrence of abnormal images such as black spots. Further, by increasing the thickness of the undercoat layer, the undercoat layer can serve to effectively compensate for the defects on the electroconductive support such as scratches and surface roughness. The conventional surface treatment steps of cutting and abrasion for the electroconductive support can be omitted when the photoconductor is produced. Even if no attention is paid to the surface profile of the electroconductive support to obtain the electroconductive support inexpensively, the defective surface profile of the electroconductive support can be sufficiently concealed by the provision of the undercoat layer for use in the present invention. In addition, the coating characteristics of a charge generation layer to be provided in the form of a thin film on the undercoat layer can be improved owing to the undercoat layer for use in the present invention. When the photoconductor thus obtained is set in an electrophotographic image forming apparatus which employs a contact-type charging method, occurrence of the discharge breakdown can be avoided.

In the present invention, it is preferable that the N-alkoxymethylated polyamide used for the undercoat layer have an alkoxyl group with 1 to 10 carbon atoms. Such an N-alkoxymethylated polyamide can show excellent solubility in a solvent for the preparation of a coating liquid. To be more specific, preferable examples of the N-alkoxymethylated polyamide having an alkoxyl group with 1 to 10 carbon atoms include methoxymethylated polyamide, ethoxymethylated polyamide, and butoxymethylated polyamide.

In the N-alkoxymethylated polyamide for use in the present invention, the degree of substitution by an alkoxymethyl group is not particularly limited, but it is preferable that hydrogen atom bonded to nitrogen atom be substituted with an alkoxymethyl group in an amount ratio of 15 mol % or more. To be more specific, provided that the number of moieties having methoxymethyl group is A and that of an unsubstituted moieties is B in the above-mentioned reaction scheme, the content of A in terms of a molar ratio, represented by $A/(A+B)\times 100$ (%), may be 15 or more. The above-mentioned molar ratio will be hereinafter referred to as an alkoxymethylation ratio. The higher the alkoxymethylation ratio, the higher the solubility of the N-alkoxymethylated polyamide in a solvent used for the preparation of a coating liquid for undercoat layer. In this case, the obtained undercoat layer becomes more uniform, and the coating characteristics of the photoconductive layer becomes better. When the photoconductor comprises such an undercoat layer, the previously mentioned discharge breakdown can be minimized even in the electrophotographic image forming apparatus employing the contact-type charging method. Further, the dispersion properties of the inorganic pigment are improved in the N-alkoxymethylated polyamide with an alkoxymethylation ratio of 15 mol % or more, so that the uniform undercoat layer can be obtained even after the inorganic pigment is dispersed in the N-alkoxymethylated polyamide.

In particular, the inventors of the present invention found that a titanium oxide which is not subjected to surface treatment, which will be described later, can be dispersed well in the N-alkoxymethylated polyamide with an alkoxymethylation ratio of 15 mol % or more. In this case, the dispersion stability of the titanium oxide can be remarkably improved, thereby drastically extending the pot life of the dispersion, that is, the coating liquid for undercoat layer. The adhesion of the photoconductive layer to the electroconductive support was also improved.

As the N-alkoxymethylated polyamide for use in the coating liquid for undercoat layer, methoxymethylated polyamide is preferable because it is easily available. The methoxymethylated polyamide for use in the present invention can be obtained by modifying polyamide 6, polyamide 12, or a copolymer polyamide comprising the above-mentioned polyamide 6 or polyamide 12 in such a manner as proposed in T. L. Cairns (J. Am. Chem. Soc. 71. p.651 (1949)). Namely, to obtain the methoxymethylated polyamide, methoxymethyl group is substituted for a hydrogen atom of amide bond in a polyamide. The methoxymethylation ratio can be determined according to the modifying conditions within a considerably wide range.

Generally used inorganic pigments are usable for the undercoat layer. In particular, white or white-tinged inorganic pigments that exhibit no absorption in the visible region and the near infrared region are preferred in view of the sensitivity of the obtained photoconductor.

Examples of the inorganic pigments for use in the undercoat layer include white pigments such as titanium oxide, zinc white, zinc sulfate, white lead, and lithopone, and extender pigments such as aluminum oxide, silica, calcium carbonate, and barium sulfate.

It is preferable that the ratio (P/R) by volume of the inorganic pigment (P) to the binder resin (R) be in the range of 0.1/1 to 5.0/1.

Of the above-mentioned inorganic pigments, titanium oxide is more preferable. This is because titanium oxide shows a relatively large refractive index, excellent chemical and physical stability, high opacifying power, and high whiteness degree, as compared with other white pigments. Any types of titanium oxide particles, for example, rutile type and anatase type are usable. With respect to aluminum oxide, general-purpose aluminum oxide can be employed.

Further, a mixture of titanium oxide and aluminum oxide is also suitable for the undercoat layer. In the course of the studies, the inventors of the present invention noticed that the photoconductor properties less varied depending upon the ambient conditions when the undercoat layer comprises a mixture of titanium oxide and aluminum oxide as the inorganic pigment component. The reason for this is that the dispersion properties of the inorganic pigment in the resin are improved when the mixture of titanium oxide and aluminum oxide is used as the inorganic pigment component. As a result, the undercoat layer can be provided with an optimal resistivity. The method of mixing titanium oxide particles and aluminum oxide particles is not particularly limited as long as both the particles can be well mixed and dispersed. It is preferable that the particle sizes of the titanium oxide particles and the aluminum oxide particles be in the range of 0.1 to 10 μm, and more preferably in the range of 0.3 to 1 μm. When the particle sizes of both particles are within the range of 0.3 to 1 μm, the dispersion properties of those particles with the resin component can be further improved, so that the electrophotographic properties can be upgraded.

In particular, it is preferable to employ a titanium oxide not subjected to surface treatment. This type of titanium oxide will be hereinafter referred to as an untreated titanium oxide. To be more specific, most of the commercially available titanium oxide particles are surface-treated using an inorganic material such as alumina or silica in order to improve the dispersion properties, weather resistance, and color fastness. However, it has been found that the photoconductor properties deteriorate under the circumstances of high temperature and humidity, or low temperature and humidity when such surface-treated titanium oxide particles are contained in the undercoat layer of the photoconductor. To minimize the deterioration of the photoconductor properties, untreated titanium oxide particles are therefore preferable.

It is preferable that the titanium oxide for use in the undercoat layer have a purity of 99.5 wt. % or more. The inorganic pigments such as titanium oxide contain hydroscopic impurities such as $Na_2O$ and $K_2O$. By the influence of such hydroscopic impurities, the characteristics of titanium oxide, even in a small amount, are susceptible to the environmental conditions. When the purity of titanium oxide for use in the undercoat layer is controlled to 99.5 wt. % or more, the environmental instability of the photoconductor properties can be reduced.

Any commercially available melamine resins can be used for crosslinking together with the above-mentioned N-alkoxymethylated polyamide. In particular, when a butylated melamine resin is used, the dispersion properties of the above-mentioned untreated titanium oxide in the resin component are remarkably improved. It is found that the increase of dispersion stability can drastically extend the pot life of the dispersion, that is, a coating liquid for undercoat layer.

The undercoat layer for use in the photoconductor of the present invention may comprise a first undercoat layer and a second undercoat layer which are successively overlaid on the electroconductive support in this order. In this case, the first undercoat layer which is formed on the electroconductive support comprises a thermosetting resin and the above-mentioned inorganic pigment dispersed therein. The second undercoat layer comprises the crosslinked N-alkoxymethylated polyamide or the crosslinked material of the N-alkoxymethylated polyamide and the melamine resin. In such a case, the water absorption properties of the crosslinked N-alkoxymethylated polyamide can be reduced, so that the dependence of the photoconductive properties upon the environmental conditions can be diminished. Further, the inorganic pigment contained in the first undercoat layer can inhibit the increase of residual potential. As a result, the thickness of the undercoat layer can be increased as a whole, which can consequently prevent the occurrence of abnormal images caused by the discharge breakdown of the undercoat layer.

The same N-alkoxymethylated polyamide and inorganic pigment as used in the single-layered undercoat layer mentioned above are usable in the case of the layered undercoat layer.

As the thermosetting resin for use in the first undercoat layer, there can be used a thermosetting resin prepared by subjecting an oil-free alkyd resin and an amino resin such as butylated melamine resin to thermal polymerization.

The thickness of the second undercoat layer is preferably in the range of 0.01 to 1 μm. When the second undercoat layer has such a thickness, occurrence of abnormal images can be effectively prevented, and the increase of residual potential can be inhibited.

According to the present invention, the method for producing the electrophotographic photoconductor comprises the steps of:

applying a coating liquid for undercoat layer comprising (a) an inorganic pigment and (b) a binder resin which is selected from the group consisting of an N-alkoxymethylated polyamide and a mixture of an N-alkoxymethylated polyamide and a melamine resin to an electroconductive support to form a coated film, heating the coated film to crosslink the N-alkoxymethylated polyamide or the mixture of N-alkoxymethylated polyamide and melamine resin, thereby providing an undercoat layer on the electroconductive support, and providing a photoconductive layer on the undercoat layer.

For the formation of the undercoat layer, the N-alkoxymethylated polyamide or the mixture of N-alkoxymethylated polyamide and melamine resin is first dissolved in a lower aliphatic alcohol such as methanol, ethanol, or propanol. To enhance the stability of the resin solution, chlorinated hydrocarbon solvents such as trichloroethane, trichloroethylene, dichloroethane, dichloromethane, and chloroform may be added.

Then, the inorganic pigment is dispersed in the above prepared resin solution. The conventional methods are adapted for dispersing the inorganic pigment in the resin solution, for example, using a ball mill, roll mill, sand mill, or attritor. Thus, a coating liquid for undercoat layer is prepared.

The coating liquid thus prepared is coated on the electroconductive support by blade coating, knife coating, spray coating, or dip coating, and thereafter dried. It is preferable that the thickness of the undercoat layer be in the range of 0.5 to 50.0 μm.

It is preferable that the coated film for undercoat layer be dried at temperature in the range of 85 to 185° C., preferably 100 to 185° C., and more preferably 100 to 135° C. in order to completely carry out the crosslinking reaction of the N-alkoxymethylated polyamide. When the drying temperature is less than 85° C., the crosslinking of N-alkoxymethylated polyamide cannot thoroughly proceed, so that the alkoxyl group remains as it is. As a result, when the photoconductor is provided with such an undercoat layer, the photoconductor properties become dependent upon the environmental conditions. On the other hand, when the coated film of undercoat layer is dried at a temperature over 185° C., there is a risk that the photoconductive properties of the obtained photoconductor may be caused to deteriorate.

In the course of preparation of the coating liquid for undercoat layer, it is preferable to employ a mixed solvent of an alcohol and a ketone. By using such a mixed solvent, the dispersion stability of the coating liquid for undercoat layer can be improved when the untreated titanium oxide is dispersed in the resin solution. This can drastically increase the pot life of the coating liquid for undercoat layer. In this case, N-alkoxymethylated polyamide and melamine resin are first dissolved in a mixed solvent of an alcohol such as methanol, ethanol, or propanol, and a ketone such as acetone, methyl ethyl ketone, methyl isobutyl ketone, or diethyl ketone. The mixing ratio of the alcohol to the ketone may be determined so that both the N-alkoxymethylated polyamide resin and the melamine resin are completely dissolved in the mixed solvent.

The dispersion properties of the inorganic pigment in the coating liquid for undercoat layer may be evaluated by the particle size distribution of inorganic pigment particles in the coating liquid, as will be described later. The particle size distribution is measured by sedimentation or light transmitting measurement. Further, the particle distribution may be directly observed using a microscope. It is preferable that the particle size of the inorganic pigment such as titanium oxide in the coating liquid be 1.0 μm or less. The dispersion with a long pot life is considered to have few coarse particles with a particle size of 1.0 μm or more immediately after the preparation of the dispersion, and show a slight change in particle size distribution after a long-term storage. On the other hand, in the dispersion with a short pot life, the inorganic pigment particles tend to aggregate and the number of coarse particles in the dispersion is increased with the elapse of storage time.

Furthermore, an acid catalyst may be added to the coating liquid for undercoat layer. When the coating liquid is made acidic by the addition of such an acid catalyst, followed by heating, crosslinking of the N-alkoxymethylated polyamide or crosslinking of the N-alkoxymethylated polyamide and the melamine resin can efficiently proceed, and the crosslinking can be performed at a practical temperature.

Examples of the acid catalyst include organic acids such as maleic acid, citric acid, and succinic acid; and inorganic acids such as boric acid and hypophosphorous acid. It is preferable that the amount of the acid catalyst be in the range of 0.1 to 10 wt. % of the total weight of N-alkoxymethylated polyamide.

When the aforementioned electrophotographic photoconductor comprising the first and second undercoat layers is fabricated, the fabricating method comprises the steps of:

providing on an electroconductive support a first undercoat layer which comprises a thermosetting resin and an inorganic pigment dispersed in the thermosetting resin, applying a coating liquid for second undercoat layer comprising a binder resin which is selected from the group consisting of an N-alkoxymethylated polyamide and a mixture of an N-alkoxymethylated polyamide and a melamine resin to the first undercoat layer to form a coated film, heating the coated film to crosslink the N-alkoxymethylated polyamide or the mixture of N-alkoxymethylated polyamide and melamine resin, thereby providing a second undercoat layer on the first undercoat layer, and providing a photoconductive layer on the second undercoat layer.

In the above-mentioned method for fabricating the electrophotographic photoconductor, a thermosetting resin is dissolved in an organic solvent to prepare a coating liquid for first undercoat layer. An inorganic pigment is then dispersed in the coating liquid, using, for example, a ball mill, roll mill, sand mill, or attritor. The coating liquid thus Prepared is coated on the electroconductive support by blade coating, knife coating, spray coating, or dip coating, and thereafter dried. The coating liquid is thus cured to form a first undercoat layer.

It is preferable that the first undercoat layer have a thickness of 0.01 to 100 μm, more preferably 2 to 50 μm. When the first undercoat layer is too thin, the images are directly influenced by the defects on the surface of the electroconductive support. When the first undercoat layer is extremely thick, the residual potential tends to increase.

On the first undercoat layer, there is provided the second undercoat layer which comprises a crosslinked N-alkoxymethylated polyamide, or a crosslinked material of N-alkoxymethylated polyamide and a melamine resin. When the crosslinked material of N-alkoxymethylated polyamide and melamine resin is employed, it is preferable that the amount ratio by weight of the melamine resin be in the range of 0.01 to 100 parts by weight to one part by weight of the N-alkoxymethylated polyamide.

The N-alkoxymethylated polyamide, or the mixture of the N-alkoxymethylated polyamide and the melamine resin is dissolved in a lower aliphatic alcohol such as methanol, ethanol, or propanol to prepare a coating liquid for second undercoat layer. In this case, chlorinated hydrocarbon solvents such as trichloroethane, trichloroethylene, dichloroethane, dichloromethane, and chloroform may be added to the coating liquid to enhance the stability thereof.

Furthermore, an acid catalyst such as an organic acid, for example, maleic acid, citric acid, or succinic acid; or an inorganic acid, for example, boric acid or hypophosphorous acid may be added to the coating liquid for second undercoat layer in order to promote the crosslinking. It is preferable that the amount of the acid catalyst be in the range of 0.1 to 10 wt. % of the weight of the N-alkoxymethylated polyamide, or the total weight of the N-alkoxymethylated polyamide and the melamine resin.

The coating liquid for second undercoat layer thus prepared is coated on the first undercoat layer by blade coating, knife coating, spray coating, or dip coating. It is preferable that the thickness of the second undercoat layer be in the range of 0.01 to 1.0 μm. When the second undercoat layer has such a thickness, the occurrence of abnormal images can be effectively prevented, and the increase of residual potential can be inhibited.

It is preferable that the coated film for the second undercoat layer be dried at a temperature of 85 to 185° C., more preferably 100 to 185° C., and further preferably 100 to 135° C., in order to completely carry out the crosslinking reaction in the coated film. When the drying temperature is less than 85° C., the crosslinking cannot thoroughly proceed, so that the number of alkoxyl groups increases. Even if the photoconductor with the above-mentioned second undercoat layer is fabricated, the photoconductor properties become dependent upon the environmental conditions.

According to the present invention, there is provided an electrophotographic image forming apparatus comprising:

an electrophotographic photoconductor, means for charging the electrophotographic photoconductor for forming a latent electrostatic image thereon, and means for developing the latent electrostatic image formed on the electrophotographic photoconductor to a visible image, wherein the electrophotographic photoconductor comprises an electroconductive support, and a photoconductive layer formed thereon, with the above-mentioned undercoat layer or first and second undercoat layers being interposed between the electroconductive support and the photoconductive layer.

Since the above electrophotographic image forming apparatus is provided with the electrophotographic photoconductor of the present invention, it is possible to constantly produce high quality images after repeated use of the photoconductor even under the circumstances of high temperature and humidity or low temperature and humidity.

With respect to the charging means for charging the surface of the photoconductor, there is a tendency that the conventional corona charging method is replaced by a contact charging method. The electrophotographic image forming apparatus employing the contact charging method has been put to practical use. The contact charging method has the advantages that the apparatus can be simplified and ozone generated by corona charging can be reduced. However, the conventional electrophotographic photoconductor cannot withstand the stress caused by the contact charging process, with the result that abnormal images are produced. When the electrophotographic photoconductor of the present invention is employed, the discharge breakdown resulting from the contact charging can be avoided because the thickness of the undercoat layer can be increased. To be more specific, according to the electrophotographic image forming apparatus of the present invention, a potential of ±600 V or more can be applied to the surface of the photoconductor by bringing a contact charger into contact with the surface of the photoconductor. In addition, the photoconductor of the present invention can stand the repetition of image forming process under the above-mentioned charging conditions.

The present invention also provides a process cartridge which is freely attachable to an electrophotographic image forming apparatus, and detachable therefrom. The process cartridge comprises an electrophotographic photoconductor, and at least one of a charging means for charging the surface of the photoconductor, a light exposure means for exposing the photoconductor to a light image to form a latent electrostatic image on the photoconductor, a developing means for developing the latent electrostatic image to a visible image, or an image transfer means for transferring the visible image formed on the photoconductor to an image receiving member, wherein the photoconductor comprises the previously mentioned undercoat layer.

The above-mentioned process cartridge is provided with the electrophotographic photoconductor of the present invention, so that high quality images can be constantly produced with no occurrence of abnormal images even under the circumstances of high temperature and humidity or low temperature and humidity when the process cartridge is set in the image forming apparatus.

According to the present invention, there is provided an electrophotographic image forming process comprising the steps of:

forming a latent electrostatic image on the surface of the previously mentioned electrophotographic photoconductor, and developing the latent electrostatic image to a visible image by reversal development.

Owing to the photoconductor of the present invention, no abnormal image occurs, and high quality images can be produced by the above-mentioned image forming process under the circumstances of high temperature and humidity or low temperature and humidity.

When the reversal development is adapted, it is desirable that the potential of a dark portion which is obtained by charging the surface of the photoconductor by charging means be adequately different from that of a light portion which is obtained by dissipating the electric charge of the charged portion by light exposure. Such an adequate difference in potential can provide excellent image formation even if those potentials vary depending upon the change in ambient conditions.

One of the methods for increasing the above-mentioned potential difference is to raise the charging potential of the photoconductor. However, the higher the charging potential, the more frequent the problem of discharge breakdown occurs in the conventional electrophotographic image forming process. According to the image forming process of the present invention, occurrence of abnormal black spot images caused by discharge breakdown can be prevented even though the surface of the photoconductor is charged so that the potential of a dark portion may be set to ±600 V to form latent electrostatic images on the surface of the photoconductor, and the latent electrostatic images are developed by reversal development.

The structure of the electrophotographic photoconductor according to the present invention will now be explained in detail with reference to FIG. 1 to FIG. 4.

An electrophotographic photoconductor shown in FIG. 1 comprises an electroconductive support 1, and an undercoat layer 2 and a photoconductive layer 3 which are successively overlaid on the electroconductive support 1 in this order.

Figure 2:
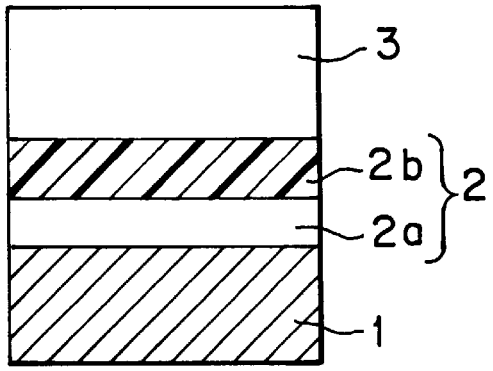
FIG. 2 is a schematic cross-sectional view which shows the second embodiment of an electrophotographic photoconductor according to the present invention.

In an electrophotographic photoconductor shown in FIG. 2, there are successively provided a first undercoat layer 2*a*, a second undercoat layer 2*b*, and a photoconductive layer 3 on an electroconductive support 1. The first undercoat layer 2*a* comprises an inorganic pigment, and the second undercoat layer 2*b* comprises a crosslinked N-methoxymethylated polyamide, or a crosslinked material of an N-methoxymethylated polyamide and a melamine resin.

Figure 3:
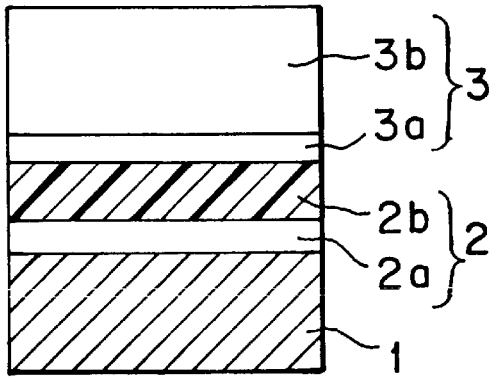
FIG. 3 is a schematic cross-sectional view which shows the third embodiment of an electrophotographic photoconductor according to the present invention.
Figure 4:
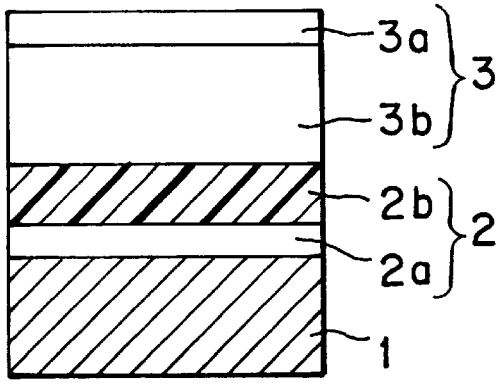
FIG. 4 is a schematic cross-sectional view which shows the fourth embodiment of an electrophotographic photoconductor according to the present invention.

In FIG. 3 and FIG. 4, a photoconductive layer 3 comprises a charge generation layer 3*a* and a charge transport layer 3*b*, thereby forming a function separating structure.

According to the present invention, any additional layers may be provided in the photoconductor as long as the undercoat (or the first undercoat layer 2*a* and the second undercoat layer 2*b*) and the photoconductive layer 3 are successively provided on the electroconductive support 1.

Any conventional electroconductive support is usable for the electrophotographic photoconductor of the present invention.

The photoconductive layer 3 will now be explained in detail.

The photoconductive layer 3 of a single-layered type as shown in FIG. 1 and FIG. 2, or of a layered type as shown in FIG. 3 and FIG. 4 is formed on the undercoat layer 2 or the second undercoat layer 2*b*. The layered type photoconductor will be described first.

The charge generation layer 3*a* comprises a charge generation material, optionally in combination with a binder resin. The charge generation material includes an organic material and an inorganic material.

Specific examples of the inorganic charge generation material are crystalline selenium, amorphous selenium, selenium—tellurium, selenium—tellurium—halogen, selenium—arsenic compound, and a-silicon (amorphous silicon). In particular, when the above-mentioned a-silicon is employed as the charge generation material, it is preferable that the dangling bond be terminated with hydrogen atom or a halogen atom, or be doped with boron atom or phosphorus atom.

Specific examples of the conventional organic charge generation materials for use in the present invention are phthalocyanine pigments such as metallo-phthalocyanine and metal-free phthalocyanine, azulenium salt pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryl oxadiazole skeleton, azo pigments having a distyryl carbazole skeleton, perylene pigments, anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoid pigments, and bisbenzimidazole pigments.

Those charge generation materials may be used alone or in combination.

Of the above-mentioned charge generation materials, the phthalocyanine pigment having a phthalocyanine skeleton is preferable in consideration of the improvement of photosensitivity and the prevention of deterioration of the photoconductor caused by the exposure to various gases such as ozone and $NO_x$ gases generated by discharging in the image forming apparatus. Further, of the metallo-phthalocyanine compounds, titanyl phthalocyanine is preferably employed.

The charge generation layer 3*a* may further comprise a low-molecular charge transport material when necessary. The low-molecular charge transport material for use in the charge generation layer 3*a* is divided into a positive hole transport material and an electron transport material.

Examples of the electron transport material are conventional electron acceptor compounds such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide. Those electron transport materials may be used alone or in combination.

Examples of the positive hole transport material for use in the charge generation layer 3*a* include electron donor compounds such as oxazole derivatives, oxadiazole derivatives, imidazole derivatives, triphenylamine derivatives, 9-(p-diethylaminostyryl anthracene), 1,1-bis-(4-dibenzylaminophenyl)propane, styryl anthracene, styryl pyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives. Those positive hole transport materials may be used alone or in combination.

Examples of the binder resin for use in the charge generation layer 3*a* are polyamide, polyurethane, epoxy resin, polyketone, polycarbonate, silicone resin, acrylic resin, poly(vinyl butyral), poly(vinyl formal), poly(vinyl ketone), polystyrene, poly-N-vinylcarbazole, and polyacrylamide. Those binder resins may be used alone or in combination.

Furthermore, high-molecular weight charge transport materials of formulas (1), (6), (14), (16), (18), and (20), which will be described later, and the following high-molecular weight charge transport materials (A) to (E) may be used as the binder resins in the charge generation layer 3*a*.

(A) Polymers having carbazole ring on the main chain and/or side chain: poly-N-vinylcarbazole, and compounds disclosed in Japanese Laid-Open Patent Applications 50-82056, 54-9632, 54-11737, and 4-183719.

(B) Polymers having hydrazone structure on the main chain and/or side chain: compounds disclosed in Japanese Laid-Open Patent Applications 57-78402 and 3-50555.

(C) Polysilylene compounds: compounds disclosed in Japanese Laid-Open Patent Applications 63-285552, 5-19497, and 5-70595.

(D) Polymers having tertiary amine structure on the main chain and/or side chain: N-bis(4-methylphenyl)-4-aminopolystyrene, and compounds disclosed in Japanese Laid-Open Patent Applications 1-13061, 1-19049, 1-1728, 1-105260, 2-167335, 5-66598, and 5-40350.

(E) Other polymers: nitropyrene—formaldehyde condensation polymer, and compounds disclosed in Japanese Laid-Open Patent Applications 51-73888 and 56-150749.

The polymeric materials having an electron donor group for use in the charge generation layer 3*a* are not limited to the above-mentioned polymers. There can be employed various copolymers, block polymers, graft polymers, and star polymers, each comprising any of the conventional monomers. For instance, crosslinked polymers having an electron donor group, for example, as disclosed in Japanese Laid-Open Patent Application 3-109406, are also usable.

The charge generation layer 3*a* can be formed by vacuum thin-film forming method or casting method using a dispersion system.

The vacuum thin-film forming method includes vacuum deposition, glow discharge, ion plating, sputtering, reactive sputtering, and chemical vapor deposition (CVD). The above-mentioned inorganic and organic charge generation materials are applicable to the vacuum thin-film forming method.

When the charge generation layer 3*a* is formed by the casting method, the above-mentioned inorganic or organic charge generation material is dispersed in a proper solvent such as tetrahydrofuran, cyclohexanone, dioxane, dichloroethane, or butanone, optionally in combination with a binder agent, in a ball mill, an attritor, or a sand mill. The dispersion thus obtained may appropriately be diluted to prepare a coating liquid for the charge generation layer 3*a*. The coating of the coating liquid for the charge generation layer 3*a* is achieved by dip coating, spray coating, or beads coating. The proper thickness of the charge generation layer 3*a* is in the range of about 0.01 to 5 μm, preferably in the range of 0.05 to 2 μm.

The charge transport layer 3*b* will now be more specifically explained.

The charge transport layer 3*b* serves to retain electric charges thereon, and allows other electric charges which have been generated in the charge generation layer 3*a* to transfer to the charge transfer layer and combine with the charges retained on the charge transport layer by light exposure. The charge transport layer 3*b* is required to have a high resistivity for retaining the electric charges, and to have a small dielectric constant and proper charge transferring properties for obtaining a high surface potential. Further, sufficient wear resistance is required in light of the mechanical stress applied to the charge transport layer, such as the physical contact with other members in the apparatus, for example, contact with a toner and a sheet of paper in the developing step, and contact with a brush and a blade in the cleaning step.

The charge transport layer 3*b* comprises a charge transport material, with a binder resin being optionally added thereto. In view of the above-mentioned requirements, it is preferable to employ a high-molecular charge transport material. Such a charge transport material and a binder resin are dissolved and dispersed in an appropriate solvent to prepare a coating liquid, and the coating liquid thus prepared is coated and dried, whereby a charge transport layer 3*b* is formed. The coating liquid for charge transport layer 3*b* may further comprise a plasticizer, an antioxidant, and a leveling agent in proper amounts.

The charge transport material for use in the charge transport layer 3*b* includes a positive hole transport material and an electron transport material.

Examples of the electron transport material for use in the charge transport layer 3*b* are conventional electron acceptor compounds such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide. Those electron transport materials may be used alone or in combination.

Examples of the positive hole transport material for use in the charge transport layer 3*b* include electron donor compounds such as oxazole derivatives, oxadiazole derivatives, imidazole derivatives, triphenylamine derivatives, 9-(p-diethylaminostyryl anthracene), 1,1-bis-(4-dibenzylaminophenyl)propane, styryl anthracene, styryl pyrazoline, phenylhydrazone, α-phenylstilbene derivatives, thiazole derivatives, triazole derivatives, phenazine derivatives, acridine derivatives, benzofuran derivatives, benzimidazole derivatives, and thiophene derivatives. Those positive hole transport materials may be used alone or in combination.

Examples of the binder resin for use in the charge transport layer 3*b* include thermoplastic resins and thermosetting resins such as polystyrene, styrene—acrylonitrile copolymer, styrene—butadiene copolymer, styrene—maleic anhydride copolymer, polyethylene, polyester, poly(vinyl chloride), vinyl chloride—vinyl acetate copolymer, poly (vinyl acetate), poly(vinylidene chloride), polyacrylate resin, methacrylate resin, phenoxy resin, polycarbonate, cellulose acetate resin, ethyl cellulose resin, poly(vinyl butyral), poly(vinyl formal), polyacrylamide, poly (vinyltoluene), poly-N-vinylcarbazole, acrylic resin, silicone resin, epoxy resin, melamine resin, urethane resin, phenolic resin, and alkyd resin.

A high-molecular weight charge transport material provided with functions both as the binder resin and the charge transport material may be used as the binder resin in the charge transport layer 3*b*. The charge transport layer 3*b* comprising the above-mentioned high-molecular weight charge transport material is excellent in the wear resistance. Examples of the above-mentioned high-molecular weight charge transport material are as follows:

(A) Polymers having carbazole ring: poly-N-vinylcarbazole, and compounds disclosed in Japanese Laid-Open Patent Applications 50-82056, 54-9632, 54-11737, 4-175337, 4-183719, and 6-234841.

(B) Polymers having hydrazone structure: compounds disclosed in Japanese Laid-Open Patent Applications 57-78402, 61-20953, 61-296358, 1-134456, 1-179164, 3-180851, 3-180852, 3-50555, 5-310904, and 6-234840.

(C). Polysilylene compounds: compounds disclosed in Japanese Laid-Open Patent Applications 63-285552, 1-88461, 4-264130, 4-264131, 4-264132, 4-264133, and 4-289867.

(D) Polymers having tertiary amine'structure: N-bis(4-methylphenyl)-4-aminopolystyrene, and compounds disclosed in Japanese Laid-Open Patent Applications 1-134457, 2-282264, 2-304456, 4-133065, 4-133066, 5-40350, and 5-202135.

(E) Other polymers: nitropyrene—formaldehyde condensation polymer, and compounds disclosed in Japanese Laid-Open Patent Applications 51-73888, 56-150749, 6-234836, and 6-234837.

The high-molecular weight charge transport material for use in the charge transport layer 3*b* is not limited to the above-mentioned polymers. There can be employed various copolymers, block polymers, graft polymers, and star polymers, each comprising any of the conventional monomers. In addition, crosslinked polymers having an electron donating group, for example, as disclosed in Japanese Laid-Open Patent Application 3-109406, are also usable.

Further, in the charge transport layer 3*b*, it is advantageous to employ as the high-molecular weight charge transport material a polycarbonate compound having a triarylamine structure, a polyurethane, a polyester, and a polyether, as disclosed in Japanese Laid-Open Patent Applications 64-1728, 64-13061, 64-19049, 4-11627, 4-225014, 4-230767, 4-320420, 5-232727, 7-56374, 9-127713, 9-222740, 9-265197, 9-211877, and 9-304956.

The polycarbonate compound having a triarylamine structure is particularly effective as the high-molecular weight charge transport material for use in the charge transport layer 3*b*. The structure of the above-mentioned polycarbonate compound is that one of the aryl groups in the triarylamine structure constitutes the side chain and is bonded to the main chain directly or via any group.

The following polycarbonate compounds of formulas (1), (6), (14), (16), (18), and (20), each having a triarylamine structure on the side chain thereof are preferably employed:

[Polycarbonate of formula (1)]

(1)

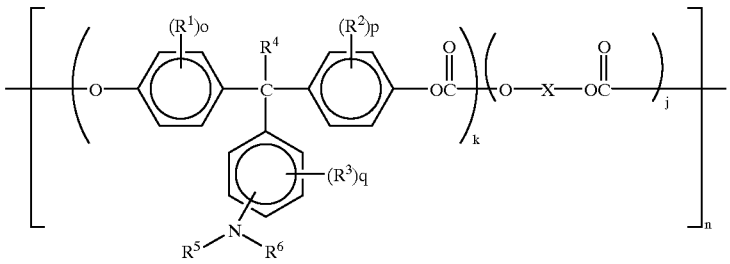

wherein $R^1$, $R^2$ and $R^3$ are each independently an alkyl group which may have a substituent, or a halogen atom; $R^4$ is hydrogen atom or an alkyl group which may have a substituent; $R^5$ and $R^6$ are each independently an aryl group which may have a substituent; o, p and q are each independently an integer of 0 to 4; k and j represent the composition ratios, $0.1 \leqq k \leqq 1$, and $0 < j \leqq 0.9$; n represents the number of repeat units, and is an integer of 5 to 5,000; and X is a bivalent aliphatic group, bivalent cyclic aliphatic group, or a bivalent group represented by formula (2):

(2)

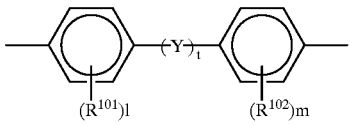

in which $R^{101}$ and $R^{102}$ may be the same or different, and are each independently an alkyl group which may have a substituent, an aryl group which may have a substituent, or a halogen atom; l and m are each independently an integer of 0 to 4; t is an integer of 0 or 1, and when t=1, Y is a straight-chain, branched or cyclic alkylene group having 1 to 12 carbon atoms, —O—, —S—, —SO—, —$SO_2$—, —CO—, —CO—O—Z—O—CO— in which Z is a bivalent aliphatic group, or the following group represented by formula (3):

(3)

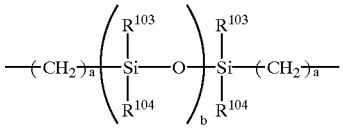

in which a is an integer of 1 to 20; b is an integer of 1 to 2,000; and $R^{103}$ and $R^{104}$, which may be the same or different, are each independently an alkyl group which may have a substituent or an aryl group which may have a substituent.

In the above-mentioned formula (1), it is preferable that the alkyl group represented by $R^1$, $R^2$ and $R^3$ be a straight chain or branched alkyl group having 1 to 12 carbon atoms, more preferably having 1 to 8 carbon atoms, and further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of the alkyl group represented by $R^1$, $R^2$ and $R^3$ are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

Examples of the halogen atom represented by $R^1$, $R^2$ and $R^3$ include fluorine atom, chlorine atom, bromine atom and iodine atom.

Specific examples of the substituted or unsubstituted alkyl group represented by $R^4$ are the same as those represented by $R^1$, $R^2$ and $R^3$ as mentioned above.

Examples of the aryl group represented by $R^5$ and $R^6$ are as follows:

aromatic hydrocarbon groups such as phenyl group;

condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

non-condensed polycyclic groups such as biphenylyl group and terphenylyl group; and heterocyclic groups such as thienyl group, benzothienyl group, furyl group, benzofuranyl group, and carbazolyl group.

The above-mentioned aryl group may have a substituent. Examples of such a substituent for $R^5$ and $R^6$ are as follows:

(a) A halogen atom, cyano group, and nitro group.

(b) An alkyl group. There can be employed the same examples as mentioned in the explanation of $R^1$, $R^2$ and $R^3$.

(c) An alkoxyl group (—$OR^{105}$) in which $R^{105}$ is the same alkyl group as previously defined in (b).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(d) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(e) A substituted mercapto group or an arylmercapto group.

Specific examples of the substituted mercapto group and arylmercapto group include methylthio group, ethylthio group, phenylthio group, and p-methylphenylthio group.

(f) An alkyl-substituted amino group. The same alkyl group as defined in (b) can be employed.

Specific examples of the alkyl-substituted amino group are dimethylamino group, diethylamino group, N-methyl-N-propylamino group, and N-dibenzylamino group.

(g) An acyl group such as acetyl group, propionyl group, butyryl group, malonyl group, and benzoyl group.

Furthermore, the above-mentioned polycarbonate compound of formula (1) can be produced in such a manner that a diol compound having triarylamino group represented by the following formula (4) is subjected to polymerization by the phosgene method or ester interchange method, using a diol compound of formula (5) in combination, so that X is introduced into the main chain of the obtained compound:

(4)

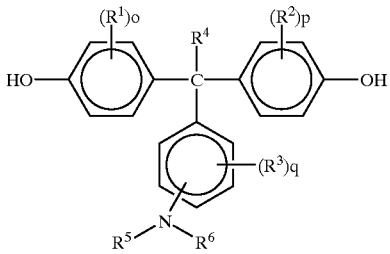

wherein $R^1$ to $R^6$, o, p and q, and X are the same as those previously defined in formula (1).

In this case, the obtained polycarbonate resin is in the form of a random copolymer or block copolymer.

Alternatively, X can also be introduced into the repeat unit of the polycarbonate resin by the polymerization reaction of the diol compound of formula (4) and a bischloroformate derived from the diol compound of formula (5). In this case, the polycarbonate resin in the form of an alternating copolymer can be obtained.

Examples of the diol compound represented by formula (5) include aliphatic diols such as 1,3-propanediol, 1,4-butanediol, 1,5-pentanediol, 1,6-hexanediol, 1,8-octanediol, 1,10-decanediol, 2-methyl-1,3-propanediol, 2,2-dimethyl-1,3-propanediol, 2-ethyl-1,3-propanediol, diethylene glycol, triethylene glycol, polyethylene glycol, and polytetramethylene ether glycol; and cyclic .aliphatic diols such as 1,4-cyclohexanediol, 1,3-cyclohexanediol, and cyclohexane-1,4-dimethanol.

Examples of the diol compound having an aromatic ring are as follows: 4,4'-dihydroxydiphenyl, bis(4-hydroxyphenyl)methane, 1,1-bis(4-hydroxyphenyl)ethane, 1,1-bis(4-hydroxyphenyl)-1-phenylethane, 2,2-bis(4-hydroxyphenyl)propane, 2,2-bis(3-methyl-4-hydroxyphenyl) propane, 1,1-bis(4-hydroxyphenyl) cyclohexane, 1,1-bis(4-hydroxyphenyl)cyclopentane, 2,2-bis(3-phenyl-4-hydroxyphenyl)propane, 2,2-bis(3-isopropyl-4-hydroxyphenyl)propane, 2,2-bis(4-hydroxyphenyl)butane, 2,2-bis(3,5-dimethyl-4-hydroxyphenyl)propane, 2,2-bis(3,5-dibromo-4-hydroxyphenyl)propane, 4,4'-dihydroxydiphenylsulfone, 4,4'-dihydroxydiphenylsulfoxide, 4,4'-dihydroxydiphenylsulfide, 3,3'-dimethyl-4,4'-dihydroxydiphenylsulfide, 4,4'-dihydroxydiphenyloxide, 2,2-bis(4-hydroxyphenyl)hexafluoropropane, 9,9-bis(4-hydroxyphenyl)fluorene, 9,9-bis(4-hydroxyphenyl) xanthene, ethylene glycol-bis(4-hydroxybenzoate), diethylene glycol-bis(4-hydroxybenzoate), triethylene glycol-bis (4-hydroxybenzoate), 1,3-bis(4-hydroxyphenyl) tetramethyl disiloxane, and phenol-modified silicone oil.

[Polycarbonate of formula (6)]

(6)

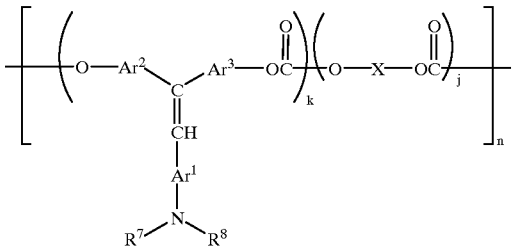

wherein $R^7$ and $R^8$ are each independently an aryl group which may have a substituent; $Ar^1$, $Ar^2$ and $Ar^3$, which may be the same or different, are each independently an arylene group; and X, k, j, and n are the same as those previously defined in formula (1).

Examples of the aryl group represented by $R^7$ and $R^8$ are as follows:

aromatic hydrocarbon groups such as phenyl group;

condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

non-condensed polycyclic groups such as biphenylyl group, terphenylyl group, and a group of the following formula (7):

(7)

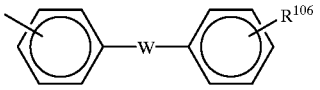

wherein W is —O—, —S—, —SO—, —CO—, or any of bivalent groups of formulas (8) to (11), $-(CH_2)_c-$ (8) in which c is an integer of 1 to 12, $-(CH{=}CH)_d-$ (9) in which d is an integer of 1 to 3,

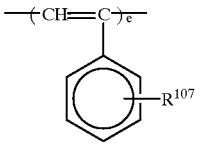

(10) in which e is an integer of 1 to 3, or

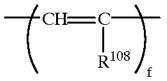

(11) in which f is an integer of 1 to 3; and heterocyclic groups such as thienyl group, benzothienyl group, furyl group, benzofuranyl group, and carbazolyl group.

As the arylene group represented by $Ar^1$, $Ar^2$ and $Ar^3$, there can be employed bivalent groups derived from the above-mentioned examples of the aryl group represented by $R^7$ and $R^8$.

The above-mentioned aryl group and arylene group may have a substituent. In the above formulas (7), (10), and (11), $R^{106}$, $R^{107}$ and $R^{108}$ also represent the substituent.

Examples of the substituent for $R^7$, $R^8$, $Ar^1$, $Ar^2$ and $Ar^3$ are as follows:

(a) A halogen atom, cyano group, and nitro group.

(b) An alkyl group, preferably a straight chain or branched alkyl group having 1 to 12 carbon atoms, more preferably having 1 to 8 carbon atoms, and further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(c) An alkoxyl group (—$OR^{109}$) in which $R^{109}$ is the same alkyl group as previously defined in (b).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(d) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(e) A substituted mercapto group or an arylmercapto group.

Specific examples of the substituted mercapto group and arylmercapto group include methylthio group, ethylthio group, phenylthio group, and p-methylphenylthio group.

(f) A substituent represented by the following formula (12):

(12)

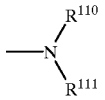

wherein $R^{110}$ and $R^{111}$ are each independently the same alkyl group as defined in (b) or an aryl group, such as phenyl group, biphenyl group, or naphthyl group.

This group of formula (12) may have a substituent such as an alkoxyl group having 1 to 4 carbon atoms, an alkyl group having 1 to 4 carbon atoms, or a halogen atom. $R^{110}$ and $R^{111}$ may form a ring in combination with the carbon atoms of the aryl group.

Specific examples of the above-mentioned group of formula (12) are diethylamino group, N-methyl-N-phenylamino group, N-diphenylamino group, N-di(p-tolyl) amino group, dibenzylamino group, piperidino group, morpholino group, and julolidyl group.

(g) An alkylenedioxy group such as methylenedioxy group, and an alkylenedithio group such as methylenedithio group.

Furthermore, the above-mentioned polycarbonate compound of formula (6) can be produced in such a manner that a diol compound having triarylamino group represented by the following formula (13) is subjected to polymerization by the phosgene method or ester interchange method using a diol compound of formula (5) in combination, so that X is introduced into the main chain of the obtained compound:

(13)

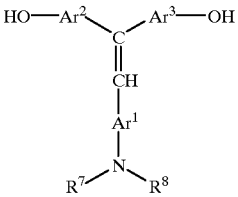

wherein $Ar^1$ to $Ar^3$, $R^7$ and $R^8$, and X are the same as those previously defined in formula (6).

In this case, the obtained polycarbonate resin is in the form of a random copolymer or block copolymer.

Alternatively, X can also be introduced into the repeat unit of the polycarbonate resin by the polymerization reaction of the diol compound of formula (13) and a bischloroformate derived from the diol compound of formula (5). In this case, the polycarbonate resin in the form of an alternating copolymer can be obtained.

Examples of the diol compound of formula (5) are the same as previously mentioned. [Polycarbonate of formula (14)]

(14)

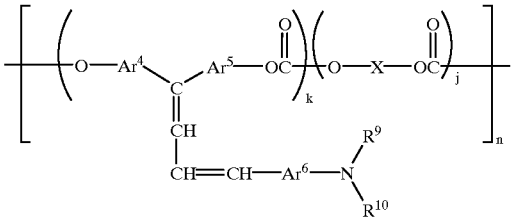

wherein $R^9$ and $R^{10}$ are each independently an aryl group which may have a substituent; $Ar^4$, $Ar^5$ and $Ar^6$, which may be the same or different, are each independently an arylene group; k, j, n, and X are the same as those previously defined in formula (1).

Examples of the aryl group represented by $R^9$ and $R^{10}$ are as follows:

aromatic hydrocarbon groups such as phenyl group;

condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

non-condensed polycyclic groups such as biphenylyl group and terphenylyl group; and heterocyclic groups such as thienyl group, benzothienyl group, furyl group, benzofuranyl group, and carbazolyl group.

As the arylene group represented by $Ar^4$, $Ar^5$ and $Ar^6$, there can be employed bivalent groups derived from the above-mentioned examples of the aryl group represented by $R^9$ and $R^{10}$.

The above-mentioned aryl group and arylene group may have a substituent.

Examples of such a substituent for $R^9$, $R^{10}$, $Ar^4$, $Ar^5$ and $Ar^6$ are as follows:

(a) A halogen atom, cyano group, and nitro group.

(b) An alkyl group, preferably a straight chain or branched alkyl group having 1 to 12 carbon atoms, more preferably having 1 to 8 carbon atoms, and further preferably having 1 to 4 carbon atoms. The alkyl group may have a substituent such as a fluorine atom, hydroxyl group, cyano group, an alkoxyl group having 1 to 4 carbon atoms, or a phenyl group which may have a substituent selected from the group consisting of a halogen atom, an alkyl group having 1 to 4 carbon atoms, and an alkoxyl group having 1 to 4 carbon atoms.

Specific examples of such an alkyl group are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, and 4-phenylbenzyl group.

(c) An alkoxyl group (—$R^{112}$) in which $R^{112}$ is the same alkyl group as previously defined in (b).

Specific examples of such an alkoxyl group are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, and trifluoromethoxy group.

(d) An aryloxy group. Examples of the aryl group for use in the aryloxy group are phenyl group and naphthyl group. The aryloxy group may have a substituent such as an alkoxyl group having 1 to 4 carbon atoms, an alkyl group having 1 to 4 carbon atoms, or a halogen atom.

Specific examples of the aryloxy group are phenoxy group, 1-naphthyloxy group, 2-naphthyloxy group, 4-methylphenoxy group, 4-methoxyphenoxy group, 4-chlorophenoxy group, and 6-methyl-2-naphthyloxy group.

(e) A substituted mercapto group or an arylmercapto group.

Specific examples of the substituted mercapto group and arylmercapto group include methylthio group, ethylthio group, phenylthio group, and p-methylphenylthio group.

(f) An alkyl-substituted amino group. The same alkyl group as defined in (b) can be employed.

Specific examples of the alkyl-substituted amino group are dimethylamino group, diethylamino group, N-methyl-N-propylamino group, and N-dibenzylamino group.

(g) an acyl group such as acetyl group, propionyl group, butyryl group, malonyl group, and benzoyl group.

Furthermore, the above-mentioned polycarbonate compound of formula (14) can be produced in such a manner that a diol compound having triarylamino group represented by the following formula (15) is subjected to polymerization by the phosgene method or ester interchange method using a diol compound of formula (5) in combination, so that X is introduced into the main chain of the obtained compound:

(15)

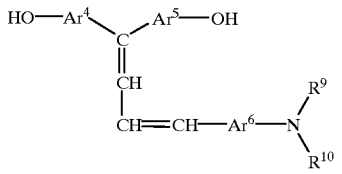

wherein $R^9$ and $R^{10}$, $Ar^4$ to $Ar^6$, and X are the same as those previously defined in formula (14).

In this case, the obtained polycarbonate resin is in the form of a random copolymer or block copolymer.

Alternatively, X can also be introduced into the repeat unit of the polycarbonate resin by the polymerization reaction of the diol compound of formula (15) and a bischloroformate derived from the diol compound of formula (5). In this case, the polycarbonate resin in the form of an alternating copolymer can be obtained.

Examples of the diol compound of formula (5) are the same as previously mentioned.

[Polycarbonate of formula (16)]

(16)

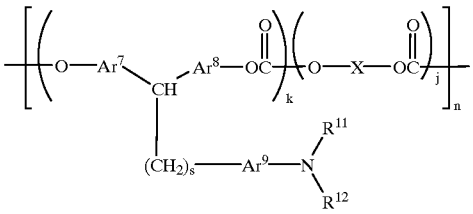

wherein $R^{11}$ and $R^{12}$ are each independently an aryl group which may have a substituent; $Ar^7$, $Ar^8$ and $Ar^9$, which may be the same or different, are each independently an arylene group; s is an integer of 1 to 5; k, j, n, and X are the same as those previously defined in formula (1).

Examples of the aryl group represented by $R^{11}$ and $R^{12}$ are as follows:

aromatic hydrocarbon groups such as phenyl group;

condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

non-condensed polycyclic groups such as biphenylyl group and terphenylyl group; and heterocyclic groups such as thienyl group, benzothienyl group, furyl group, benzofuranyl group, and carbazolyl group.

As the arylene group represented by $Ar^7$, $Ar^8$ and $Ar^9$, there can be employed bivalent groups derived from the above-mentioned examples of the aryl group represented by $R^{11}$ and $R^{12}$.

The above-mentioned aryl group and-arylene group may have a substituent.

The same substituents (a) to (g) for the aryl group and arylene group as mentioned in the compound of formula (14) can be employed for $R^{11}$, $R^{12}$, $Ar^7$, $Ar^8$ and $Ar^9$.

Furthermore, the above-mentioned polycarbonate compound of formula (16) can be produced in such a manner that a diol compound having triarylamino group represented by the following formula (17) is subjected to polymerization by the phosgene method or ester interchange method using a diol compound of formula (5) in combination, so that X is introduced into the main chain of the obtained compound:

(17)

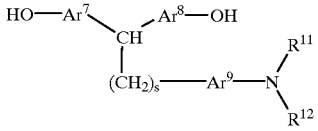

wherein $R^{11}$ and $R^{12}$, $Ar^7$ to $Ar^9$, s, and X are the same as those previously defined in formula (16).

In this case, the obtained polycarbonate resin is in the form of a random copolymer or block copolymer.

Alternatively, X can also be introduced into the repeat unit of the polycarbonate resin by the polymerization reaction of the diol compound of formula (17) and a bischloroformate derived from the diol compound of formula (5). In this case, the polycarbonate resin in the form of an alternating copolymer can be obtained.

Examples of the diol compound of formula (5) are the same as previously mentioned.

[Polycarbonate of formula (18)]

(18)

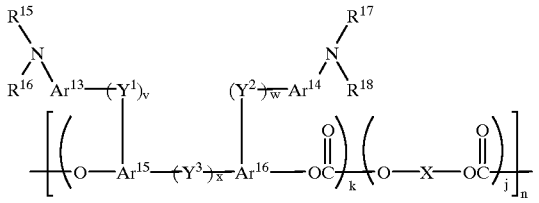

wherein $R^{15}$, $R^{16}$, $R^{17}$, and $R^{18}$ are each independently an aryl group which may have a substituent; $Ar^{13}$, $Ar^{14}$, $Ar^{15}$, and $Ar^{16}$, which may be the same or different, are each independently an arylene group; v, w and x are each independently an integer of 0 or 1, and when v, w and x are an integer of 1, $Y^1$, $Y^2$ and $Y^3$, which may be the same or different, are each independently an alkylene group which may have a substituent, a cycloalkylene group which may have a substituent, an alkylene ether group which may have a substituent, oxygen atom, sulfur atom, or vinylene group; k, j, n, and X are the same as those previously defined in formula (1).

Examples of the aryl group represented by $R^{15}$ to $R^{18}$ are as follows:

aromatic hydrocarbon groups such as phenyl group;

condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

non-condensed polycyclic groups such as biphenylyl group and terphenylyl group; and heterocyclic groups such as thienyl group, benzothienyl group, furyl group, benzofuranyl group, and carbazolyl group.

As the arylene group represented by $Ar^{13}$ to $Ar^{16}$, there can be employed bivalent groups derived from the above-mentioned examples of the aryl group represented by $R^{15}$ to $R^{18}$.

The above-mentioned aryl group and arylene group may have the same substituents (a) to (d) as mentioned in the compound of formula (14).

When $Y^1$ to $Y^3$ are each independently an alkylene group, there can be employed bivalent groups derived from the same examples of the alkyl group as described as the substituent (b) for the aryl group or arylene group in the explanation of formula (14).

Specific examples of the alkylene group represented by $Y^1$ to $Y^3$ are methylene group, ethylene group, 1,3-propylene group, 1,4-butylene group, 2-methyl-1,3-propylene group, difluoromethylene group, hydroxyethylene group, cyanoethylene group, methoxyethylene group, phenylmethylene group, 4-methylphenylmethylene group, 2,2-propylene group, 2,2-butylene group, and diphenylmethylene group.

Examples of the cycloalkylene group represented by $Y^1$ to $Y^3$ are 1,1-cyclopentylene group, 1,1-cyclohexylene group, and 1,1-cyclooctylene group.

Examples of the alkylene ether group represented by $Y^1$ to $Y^3$ are dimethylene ether group, diethylene ether group, ethylene methylene ether group, bis(triethylene) ether group, and polytetramethylene ether group.

Furthermore, the above-mentioned polycarbonate compound of formula (18) can be produced in such a manner that a diol compound having triarylamino group represented by the following formula (19) is subjected to polymerization by the phosgene method or ester interchange method using a diol compound of formula (5) in combination, so that X is introduced into the main chain of the obtained compound:

(19)

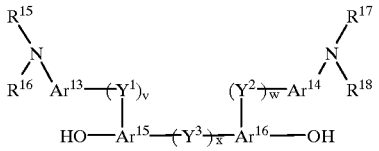

wherein $R^{15}$ to $R^{18}$, $Ar^{13}$ to $Ar^{16}$, $Y^1$ to $Y^3$, v, w, x and X are the same as those previously defined in formula (18).

In this case, the obtained polycarbonate resin is in the form of a random copolymer or block copolymer.

Alternatively, X can also be introduced into the repeat unit of the polycarbonate resin by the polymerization reaction of the diol compound of formula (19) and a bischloroformate derived from the diol compound of formula (5). In this case, the polycarbonate resin in the form of an alternating copolymer can be obtained.

Examples of the diol compound of formula (5) are the same as previously mentioned.

[Polycarbonate of formula (20)]

(20)

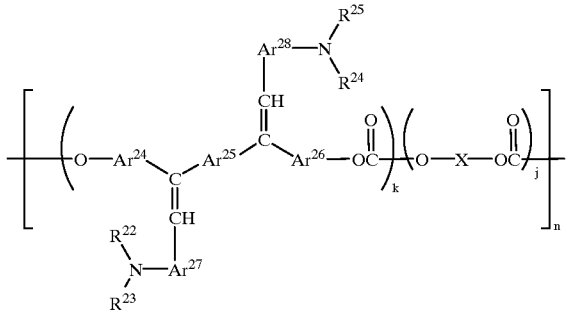

wherein $R^{22}$, $R^{23}$, $R^{24}$ and $R^{25}$ are each independently an aryl group which may have a substituent; $Ar^{24}$, $Ar^{25}$, $Ar^{26}$, $Ar^{27}$ and $Ar^{28}$, which may be the same or different, are each independently an arylene group; k, j, n, and X are the same as those previously defined in formula (1).

Examples of the aryl group represented by $R^{22}$, $R^{23}$, $R^{24}$ and $R^{25}$ are as follows:

aromatic hydrocarbon groups such as phenyl group;

condensed polycyclic groups such as naphthyl group, pyrenyl group, 2-fluorenyl group, 9,9-dimethyl-2-fluorenyl group, azurenyl group, anthryl group, triphenylenyl group, chrysenyl group, fluorenylidenephenyl group, and 5H-dibenzo[a,d]cycloheptenylidenephenyl group;

non-condensed polycyclic groups such as biphenylyl group and terphenylyl group; and heterocyclic groups such as thienyl group, benzothienyl group, furyl group, benzofuranyl group, and carbazolyl group.

As the arylene group represented by $Ar^{24}$ to $Ar^{28}$, there can be employed bivalent groups derived from the above-mentioned examples of the aryl group represented by $R^{22}$ to $R^{25}$.

The above-mentioned aryl group and arylene group may have the same substituents (a) to (g) as mentioned in the compound of formula (14).

Furthermore, the above-mentioned polycarbonate compound of formula (20) can be produced in such a manner that a diol compound having triarylamino group represented by the following formula (21) is subjected to polymerization by the phosgene method or ester interchange method using a diol compound of formula (5) in combination, so that X is introduced into the main chain of the obtained compound:

(21)

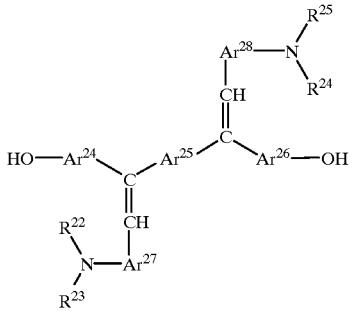

wherein $R^{22}$ to $R^{25}$, $Ar^{24}$ to $Ar^{28}$, and X are the same as those previously defined in formula (20).

In this case, the obtained polycarbonate resin is in the form of a random copolymer or block copolymer.

Alternatively, X can also be introduced into the repeat unit of the polycarbonate resin by the polymerization reaction of the diol compound of formula (21) and a bischloroformate derived from the diol compound of formula (5). In this case, the polycarbonate resin in the form of an alternating copolymer can be obtained.

Examples of the diol compound of formula (5) are the same as previously mentioned.

In addition to the above-mentioned polycarbonate compounds of formulas (1), (6), (14), (16), (18), and (20), there can be employed other conventional polycarbonate compounds having a triarylamine structure on the side chain thereof, as disclosed in Japanese Laid-Open Patent Applications 6-234838, 6-234839, 6-295077, 7-325409, 9-297419, 9-80783, 9-80784, 9-80772, and 9-265201.

To prepare a coating liquid for charge transport layer, the solvents such as tetrahydrofuran, dioxane, toluene, monochlorobenzene, dichloroethane, and methylene chloride can be employed.

It is preferable that the thickness of the charge transport layer 3*b* be in the range of about 5 to 100 μm, more preferably in the range of 10 to 22 μm. When the thickness of the charge transport layer 3*b* is 10 to 22 μm, the reproducibility of images such as thin line images and small dot images is still more improved.

The charge transport layer 3*b* may further comprise a plasticizer, an antioxidant, a leveling agent, and a lubricant.

Any plasticizers that are contained in the general-purpose resins, such as dibutyl phthalate and dioctyl phthalate can be used as it is. It is proper that the amount of plasticizer be in the range of 0 to about 30 wt. % of the total weight of the binder resin for use in the charge transport layer 3*b*.

With respect to the antioxidant, any antioxidants used in the general-purpose resins, for example, a phenol type antioxidant, quinone type antioxidant, amine type antioxidant, sulfur-containing antioxidant, and phosphorus-containing antioxidant are usable. It is proper that the amount of antioxidant for use in the charge transport layer 3*b* be in the range of 0 to about 30 wt. % of the total weight of the binder resin for use in the charge transport layer 3*b*.

As the leveling agent for use in the charge transport layer 3*b*, there can be employed silicone oils such as dimethyl silicone oil and methylphenyl silicone oil, and polymers and oligomers having a perfluoroalkyl group on the side chain thereof. The proper amount of leveling agent is at most about 5 wt. % of the total weight of the binder resin for use in the charge transport layer 3*b*.

As the lubricant, there can be employed the same silicone oils as listed as the above-mentioned leveling agent, and fluorine-containing resins, natural waxes, and metallic soaps which are used as the lubricant for the general-purpose resins. It is preferable that the amount of lubricant be in the range of 0 to about 30 wt. % of the total weight of the binder resin for use in the charge transport layer 3*b*.

As previously mentioned, the photoconductive layer 3 is of a single-layered type is usable as shown in FIG. 1 and FIG. 2.

When the single-layered photoconductive layer 3 is provided on the undercoat layer by casting method, for instance, a charge generation material, a low-molecular weight charge transport material, a high-molecular weight charge transport material, and a silicone oil are dissolved and dispersed in an appropriate solvent to prepare a coating liquid. The coating liquid thus prepared is coated on the undercoat layer and dried, so that a photoconductive layer can be provided on the undercoat layer. The same charge generation materials and charge transport materials as previously mentioned in the description of the charge generation layer 3*a* and the charge transport layer 3*b* can be used for the single-layered photoconductive layer 3.

The single-layered photoconductive may layer 3 may comprise a plasticizer when necessary. Further, when the binder resin is used for the formation of the single-layered photoconductive layer 3, the same binder resins as employed for the formation of the charge transport layer 3*b* can be preferably employed, which may be used in combination with the same binder resins as for the formation of the charge generation layer 3*a*.

It is preferable that the thickness of the single-layered photoconductive layer 3 be in the range of about 5 to 100 μm, more preferably in the range of about 10 to 22 μm.

The electrophotographic photoconductor of the present invention may further comprise a protective layer which is overlaid on the photoconductive layer to protect the photoconductive layer.

The protective layer comprises a resin as the main component.

Examples of the resin for use in the protective layer are ABS resin, ACS resin, copolymer of olefin and vinyl monomer, chlorinated polyether, allyl resin, phenolic resin, polyacetal, polyamide, polyamideimide, polyacrylate, polyallyl sulfone, polybutylene, polybutylene terephthalate, polycarbonate, polyether sulfone, polyethylene, polyethylene terephthalate, polyimide, acrylic resin, polymethyl pentene, polypropylene, polyphenylene oxide, polysulfone, polystyrene, AS resin, butadiene—styrene copolymer, polyurethane, polyvinyl chloride, polyvinylidene chloride, and epoxy resin.

To improve the wear resistance of the photoconductor, fluoroplastics such as polytetrafluoroethylene and silicone resins may be added to the protective layer. Further, an inorganic material such as titanium oxide, tin oxide, or potassium titanate may be dispersed in the above-mentioned resins for use in the protective layer.

The protective layer can be provided by any of the conventional coating methods, and the thickness of the protective layer is preferably in the range of about 0.1 to 10 μm.

Furthermore, the protective layer can be prepared by vacuum thin film-forming method using conventional materials such as a-C and a-SiC.

In the electrophotographic image forming apparatus of the present invention, there is provided an electroconductive charging unit configured to charge the surface of the photoconductor. The charging unit can be disposed to come in contact with the surface of the photoconductor, and a voltage can be directly applied to the photoconductor so that the surface of the photoconductor can be uniformly charged to a predetermined potential.

Examples of the above-mentioned electroconductive material for the charging unit include metals such as aluminum, iron, and copper; electroconductive polymeric materials such as polyacetylene, polypyrrole, and polythiophene; rubbers and artificial fibers prepared by dispersing electroconductive particles of carbon black and metal powders in electrically insulating resins such as polycarbonate, polyvinyl, and polyethylene so that the rubbers and fibers become electroconductive; and electrically insulating resins of which surfaces are coated with electroconductive materials.

The above-mentioned charging unit may be prepared in any form, for example, a roller, brush, blade, or belt.

The voltage applied to the electroconductive charging unit may be any of direct current, alternating current, or the combination of direct current and alternating current. Further, the predetermined voltage may be instantaneously applied to the charging unit, or the applied voltage may be stepwise increased.

Other features of this invention will become apparent in the course of the following description of exemplary embodiments, which are given for illustration of the invention and are not intended to be limiting thereof.

EXAMPLE 1

Preparation of Electrophotographic Photoconductor (Formation of undercoat layer)

73 parts by weight of a methoxymethylated polyamide (with a methoxymethylation ratio of 30 mol %) were dissolved in 1000 parts by weight of methanol. With the addition of 281.3 parts by weight of rutile type titanium oxide particles not subjected to surface treatment, the above-mentioned mixture was dispersed in a ball mill for 72 hours. Thereafter, 36.5 parts by weight of a methanol solution of tartaric acid (with a solid content of 10 wt. %) were added to the above-mentioned mixture, so that a coating liquid for undercoat layer was prepared.

The coating liquid thus prepared was coated on the outer surface of an aluminum drum with a diameter of 30 mm and a length of 340 mm, and dried at 130° C. for 20 minutes, whereby an undercoat layer with a thickness of 3.5 μm was provided on the aluminum drum.

[Formation of charge generation layer]

5 parts by weight of a commercially available butyral resin (Trademark "S-Lec BMS", made by Sekisui Chemical Co., Ltd.) were dissolved in 150 parts by weight of cyclohexanone. 15 parts by weight of a trisazo pigment of the following formula (22) were added to the above prepared butyral resin solution, and the resultant mixture was dispersed in a ball mill for 72 hours.

(22)

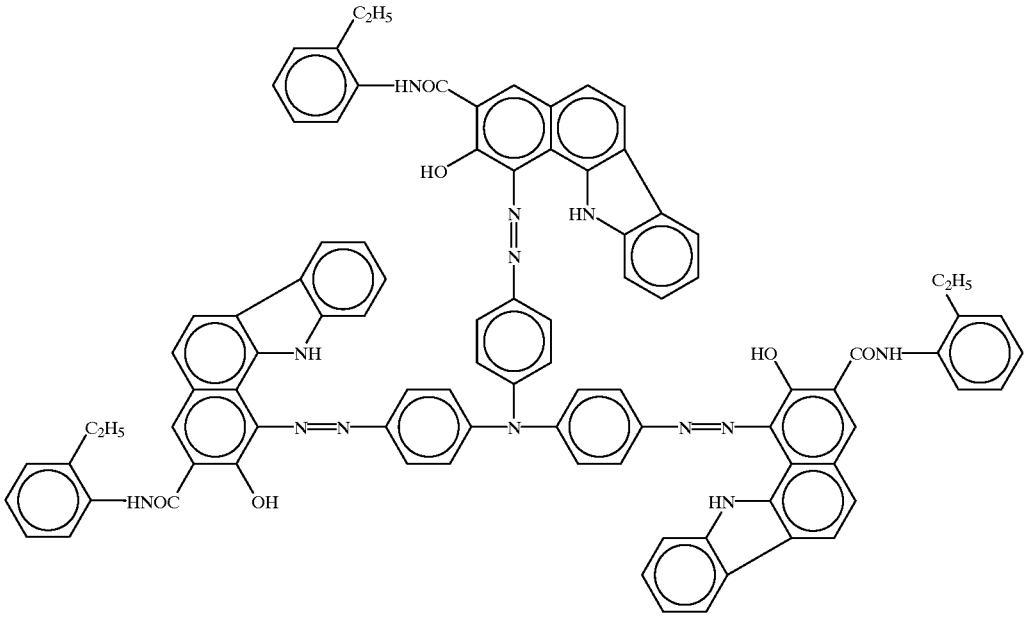

With the addition of 210 parts by weight of cyclohexanone, dispersing operation was further continued for 5 hours. Then, the mixture was diluted with cyclohexanone to have a solid content of 1.0 wt. % with stirring, so that a coating liquid for charge generation layer was prepared.

The coating liquid thus prepared was coated on the undercoat layer by dip coating, dried at 120° C. for 10 minutes, so that a charge generation layer with a thickness of about 0.2 μm was provided on the undercoat layer.

[Formation of charge transport layer]

8.5 parts by weight of a charge transport material of the following formula (23), 10 parts by weight of a commercially available polycarbonate resin (Trademark "Panlite C-1400", made by Teijin Chemicals Ltd.), and 0.002 parts by weight of a commercially available silicone oil (Trademark "KF-50", made by Shin-Etsu Chemical Co., Ltd.) were dissolved in 85 parts by weight of methylene chloride, whereby a coating liquid for charge transport layer was prepared.

(23)

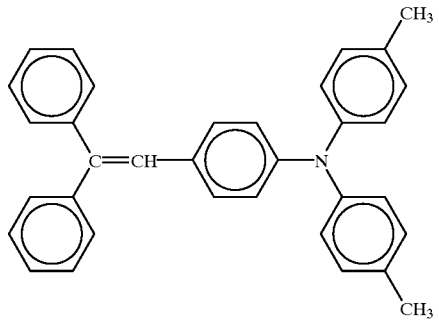

The coating liquid thus prepared was coated on the charge generation layer by dip coating, and dried at 130° C. for 20 minutes, so that a charge transport layer with a thickness of 25 μm was provided on the charge generation layer.

Thus, an electrophotographic photoconductor No. 1 according to the present invention was obtained.

EXAMPLE 2

The procedure for preparation of the electrophotographic photoconductor No. 1 as in Example 1 was repeated except that the rutile type titanium oxide used as the inorganic pigment for use in the undercoat layer coating liquid in Example 1 was replaced by a mixture of 281.3 parts by weight of anatase-type untreated titanium oxide and 2 parts by weight of aluminum oxide.

Thus, an electrophotographic photoconductor No. 2 according to the present invention was obtained.

EXAMPLE 3

The procedure for preparation of the electrophotographic photoconductor No. 2 as in Example 2 was repeated except that the trisazo pigment of formula (22) for use in the charge generation layer coating liquid in Example 2 was replaced by A-type titanyl phthalocyanine.

Thus, an electrophotographic photoconductor No. 3 according to the present invention was obtained.

COMPARATIVE EXAMPLE 1

The procedure for preparation of the electrophotographic photoconductor No. 1 as in Example 1 was repeated except that the tartaric acid for use in the undercoat layer coating liquid in Example 1 was not employed, and that the drying temperature for formation of the undercoat layer was changed from 130 to 80° C. so as not to crosslink the methoxymethylated polyamide.

Thus, a comparative electrophotographic photoconductor No. 1 was obtained.

<Image Formation Test>

Each of the electrophotographic photoconductors Nos. 1 to 3 respectively fabricated in Examples 1 to 3 and the comparative electrophotographic photoconductor No. 1 fabricated in Comparative Example 1 was placed in a commercially available copying machine (Trademark "IMAGIO MF-2200", made by Ricoh Company, Ltd.) where a contact type charger in the form of a roller and reversal development system were adapted.

Under the circumstances of 22° C. and 50% RH, 10° C. and 15% RH, and 30° C. and 90% RH, 10,000 copies (A4 landscape) were continuously made. The surface potentials of a dark portion (non-light exposed portion) (VD) and a light portion (light exposed portion) (VL) of each photoconductor were measured at the initial stage of the continuous copying operation and after making of 10,000 copies. The surface potentials (VD) and (VL) of each photoconductor were initially set to −900 V and −200 V, respectively.

Further, the obtained image qualities were visually evaluated.

The results are shown in TABLE 1.

TABLE 1

| | At initial stage | | | After making of 10,000 copies | | |
|---|---|---|---|---|---|---|
| | VD | VL | Image quality | VD | VL | Image quality |
| Image Formation Test (22° C., 50%RH) | | | | | | |
| Ex. 1 | −900 V | −200 V | good | −950 V | −270 V | slight toner deposition on background (acceptable for practical use) |
| Ex. 2 | −900 V | −200 V | good | −950 V | −275 V | good |
| Ex. 3 | −900 V | −200 V | good | −950 V | −260 V | good |
| Comp. Ex. 1 | −900 V | −200 V | good | −1000 V | −400 V | decrease of image density |
| Image Formation Test (10° C., 15%RH) | | | | | | |
| Ex. 1 | −900 V | −200 V | good | −950 V | −280 V | slight toner deposition on background (acceptable for practical use) |
| Ex. 2 | −900 V | −200 V | good | −950 V | −285 V | good |
| Ex. 3 | −900 V | −200 V | good | −960 V | −270 V | good |
| Comp. Ex. 1 | −900 V | −200 V | good | −1000 V | −450 V | decrease of image density |

TABLE 1-continued

| | At initial stage | | | After making of 10,000 copies | | |
|---|---|---|---|---|---|---|
| | VD | VL | Image quality | VD | VL | Image quality |
| | | | Image Formation Test (30° C., 90%RH) | | | |
| Ex. 1 | −900 V | −200 V | good | −950 V | −260 V | slight toner deposition on background (acceptable for practical use) |
| Ex. 2 | −900 V | −200 V | good | −950 V | −260 V | good |
| Ex. 3 | −900 V | −200 V | good | −950 V | −260 V | good |
| Comp. Ex. 1 | −900 V | −200 V | good | −950 V | −600 V | decrease of image density |

Regardless of the ambient conditions, the electrophotographic photoconductors No. 1 to No. 3 according to the present invention produced good image quality. When the comparative photoconductor No. 1 was employed, the decrease in image density was observed after repeated use. The initial surface potential (VL: −200 V) of the photoconductors No. 1 to No. 3 according to the present invention was changed only by 60 to 85 V after making of 10,000 copies under any of the above-mentioned ambient conditions, while the surface potential (VL: −200 V) of the comparative photoconductor No. 1 was largely changed by as much as 200 to 400 V. Namely, the photoconductor of the present invention is considered to be less dependent upon the ambient conditions. The potential of the light exposed portion can be prevented from increasing when the electrophotographic process is repeated. Namely, deterioration of the photoconductor properties can be prevented.

EXAMPLE 4

(Formation of undercoat layer)

73 parts by weight of a methoxymethylated polyamide (with a methoxymethylation ratio of 13 mol %) were dissolved in a mixed solvent of 665 parts by weight of methanol and 285 parts by weight of n-butanol. With the addition of 560 parts by weight of rutile-type untreated titanium oxide particles, the above-mentioned mixture was dispersed in a ball mill for 90 hours. Thereafter, 22 parts by weight of a methanol solution of hypophosphorous acid (with a solid content of 10 wt. %) were added to the above-mentioned mixture, so that a coating liquid for undercoat layer was prepared.

The coating liquid thus prepared was coated on the outer surface of an aluminum drum with a diameter of 80 mm and a length of 360 mm, and dried at 125° C. for 30 minutes, whereby an undercoat layer with a thickness of 7.0 μm was provided on the aluminum drum.

[Formation of charge generation layer]

5 parts by weight of a commercially available butyral resin (Trademark "S-Lec BMS", made by Sekisui Chemical Co., Ltd.) were dissolved in 150 parts by weight of cyclohexanone. 15 parts by weight of the above-mentioned trisazo pigment of formula (22) were added to the above prepared butyral resin solution, and the resultant mixture was dispersed in a ball mill for 72 hours.

With the addition of 210 parts by weight of cyclohexanone, dispersing operation was further continued for 5 hours. Then, the mixture was diluted with cyclohexanone to have a solid content of 1.0 wt. % with stirring, so that a coating liquid for charge generation layer was prepared.

The coating liquid thus prepared was coated on the undercoat layer by dip coating, dried at 120° C. for 10 minutes, so that a charge generation layer with a thickness of about 0.2 μm was provided on the undercoat layer.

[Formation of charge transport layer]

9.5 parts by weight of a charge transport material of the following formula (24), 10 parts by weight of a commercially available polycarbonate resin (Trademark "Panlite L-1250", made by Teijin Chemicals Ltd.), and 0.002 parts by weight of a commercially available silicone oil (Trademark "KF-50", made by Shin-Etsu Chemical Co., Ltd.) were dissolved in 85 parts by weight of methylene chloride, whereby a coating liquid for charge transport layer was prepared.

(24)

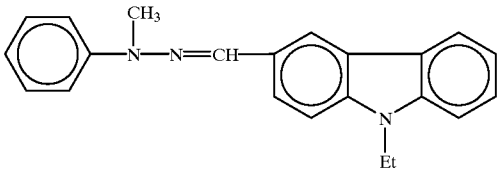

The coating liquid thus prepared was coated on the charge generation layer by dip coating, and dried at 130° C. for 20 minutes, so that a charge transport layer with a thickness of 20 μm was provided on the charge generation layer.

Thus, an electrophotographic photoconductor No. 4 according to the present invention was obtained.

EXAMPLE 5

The procedure for preparation of the electrophotographic photoconductor No. 4 as in Example 4 was repeated except that the methoxymethylated polyamide with a methoxymethylation ratio of 13 mol % for use in the undercoat layer coating liquid in Example 4 was replaced by a methoxymethylated polyamide with a methoxymethylation ratio of 20 mol %.

Thus, an electrophotographic photoconductor No. 5 according to the present invention was obtained.

EXAMPLE 6

The procedure for preparation of the electrophotographic photoconductor No. 5 as in Example 5 was repeated except that the drying temperature for formation of the undercoat layer was changed from 125 to 95° C.

Thus, an electrophotographic photoconductor No. 6 according to the present invention was obtained.

COMPARATIVE EXAMPLE 2

The procedure for preparation of the electrophotographic photoconductor No. 4 as in Example 4 was repeated except that the hypophosphorous acid for use in the undercoat layer coating liquid in Example 4 was not employed, and that the drying temperature for formation of the undercoat layer was changed from 125 to 95° C. so as not to crosslink the methoxymethylated polyamide.

Thus, a comparative electrophotographic photoconductor No. 2 was obtained.

<Image Formation Test>

Each of the electrophotographic photoconductors Nos. 4 to 6 respectively fabricated in Examples 4 to 6 and the comparative electrophotographic photoconductor No. 2 fabricated in Comparative Example 2 was placed in a commercially available copying machine (Trademark "IMAGIO 420V", made by Ricoh Company, Ltd.) which was modified as shown below.

Charging method: contact charging by use of a roller

Initial VD: −700 V

Initial VL: −150 V

Developing bias: −500 V

Developing method: reversal development

Under the circumstances of 20° C. and 52% RH, 3,000 copies (A4 landscape) were continuously made. The image qualities obtained at the initial stage and after making of 3,000 copies were visually evaluated.

The results are shown in TABLE 2.

TABLE 2

| | Initial Image Quality | Image Quality after Making of 3,000 copies |
|---|---|---|
| Ex. 4 | good | slight toner deposition on background (acceptable for practical use) |
| Ex. 5 | good | good |
| Ex. 6 | good | slight decrease of image density (acceptable for practical use) |
| Comp. Ex. 2 | good | decrease of image density |

As is apparent from the results shown in TABLE 2, the image qualities obtained by the photoconductors No. 4 to No. 6 were satisfactory or acceptable for practical use after making of 3,000 copies. In contrast to this, the image density was decreased as the comparative photoconductor No. 2 was repeatedly used. It is confirmed that the photoconductors of the present invention are less susceptible to deterioration even after repeated use.

EXAMPLE 7

The procedure for preparation of the electrophotographic photoconductor No. 5 as in Example 5 was repeated except that an aluminum drum with a diameter of 30 mm and a length of 340 mm was used as the electroconductive support, and that the thickness of the charge transport layer was changed from 20 to 15 μm.

Thus, an electrophotographic photoconductor No. 7 according to the present invention was obtained.

COMPARATIVE EXAMPLE 3

The procedure for preparation of the electrophotographic photoconductor No. 7 as in Example 7 was repeated except that the hypophosphorous acid for use in the undercoat layer coating liquid in Example 7 was not employed, and that the drying temperature for formation of the undercoat layer was changed from 125 to 90° C. so as not to crosslink the methoxymethylated polyamide, and that the thickness of the undercoat layer was changed from 7.0 to 0.3 μm.

Thus, a comparative electrophotographic photoconductor No. 3 was obtained.

COMPARATIVE EXAMPLE 4

The procedure for preparation of the electrophotographic photoconductor No. 7 as in Example 7 was repeated except that the hypophosphorous acid for use in the undercoat layer coating liquid in Example 7 was not employed, and that the drying temperature for formation of the undercoat layer was changed from 125 to 90° C. so as not to crosslink the methoxymethylated polyamide.

Thus, a comparative electrophotographic photoconductor No. 4 was obtained.

COMPARATIVE EXAMPLE 5

(Formation of undercoat layer)

73 parts by weight of a methoxymethylated polyamide (with a methoxymethylation ratio of 20 mol %) were dissolved in a mixed solvent of 154 parts by weight of methanol and 66 parts by weight of n-butanol. Thereafter, 22 parts by weight of a methanol solution of hypophosphorous acid (with a solid content of 10 wt. %) were added to the above-mentioned mixture, so that a coating liquid for undercoat layer was prepared.

The coating liquid thus prepared was coated on the outer surface of an aluminum drum with a diameter of 30 mm and a length of 340 mm, and dried at 125° C. for 30 minutes, whereby an undercoat layer with a thickness of 0.3 μm was provided on the aluminum drum.

The charge generation layer and the charge transport layer were successively overlaid on the above prepared undercoat layer in the same manner as in Example 7.

Thus, a comparative electrophotographic photoconductor No. 5 was obtained.

COMPARATIVE EXAMPLE 6

The procedure for preparation of the comparative electrophotographic photoconductor No. 5 as in Comparative Example 5 was repeated except that the thickness of the undercoat layer was changed from 0.3 to 2.8 μm.

Thus, a comparative electrophotographic photoconductor No. 6 was obtained.

<Image Formation Test>

Each of the electrophotographic photoconductor No. 7 fabricated in Example 7 and the comparative electrophotographic photoconductors Nos. 3 to 6 respectively fabricated in Comparative Examples 3 to 6 was placed in a commercially available copying machine (Trademark "IMAGIO MF-250M", made by Ricoh Company, Ltd.) where a contact type charger in the form of a roller and reversal development system were adapted.

The surface potentials of a dark portion (non-light exposed portion) (VD) and a light portion (light exposed portion) (VL) of each photoconductor were initially set to −600 V and −100 V, respectively, and the developing bias was set to −450 V.

Under the circumstances of 20° C. and 52% RH, 1,000 copies (A4 landscape) were continuously made. The image qualities obtained at the initial stage and after making of 1,000 copies were visually evaluated.

The results are shown in TABLE 3.

TABLE 3

| | Initial Image Quality | Image Quality after Making of 1,000 copies |
|---|---|---|
| Ex. 7 | good | good |
| Comp. Ex. 3 | good | numerous black spots due to discharge breakdown |
| Comp. Ex. 4 | good | decrease of image density |
| Comp. Ex. 5 | good | numerous black spots due to discharge breakdown |
| Comp. Ex. 6 | slight decrease of image density | decrease of image density |

As is apparent from the results shown in TABLE 3, the photoconductor No. 7 produced satisfactory images after continuous making of copies. In contrast to this, there appeared abnormal images after making of continuous copies when the comparative photoconductors Nos. 3 and 4 were employed. The comparative photoconductors Nos. 3 and 5 had a considerably thin undercoat layer, so that discharge breakdown took place. Since titanium oxide was not added to the undercoat layer in the comparative photoconductors Nos. 5 and 6, abnormal images appeared with the repetition use of the photoconductors.

EXAMPLE 8

[Formation of first undercoat layer]

150 parts by weight of a commercially available alkyd resin (Trademark "Beckosol 1307-60EL", made by Dainippon Ink & Chemicals, Incorporated) with a solid content of 60 wt. %, and 100 parts by weight of a commercially available melamine resin (Trademark "Super Beckamine L-110-60", made by Dainippon Ink & Chemicals, Incorporated) with a nonvolatile content of 60 wt. % were dissolved in 500 parts by weight of methyl ethyl ketone. With the addition of 600 parts by weight of titanium oxide particles (Trademark "CR-EL", made by Ishihara Sangyo Kaisha, Ltd.), the resultant mixture was dispersed in a ball mill for 72 hours. Thus, a coating liquid for first undercoat layer was prepared.

The coating liquid thus prepared was coated on the outer surface of an aluminum drum with a diameter of 30 mm and a length of 340 mm, and dried at 130° C. for 20 minutes. Thus, a first undercoat layer with a thickness of 3.8 μm was provided on the aluminum drum.

[Formation of second undercoat layer]

80 parts by weight of a methoxymethylated polyamide (with a methoxymethylation ratio of 30 mol %) were dissolved in a mixed solvent of 700 parts by weight of methanol and 300 parts by weight of n-butanol. Thereafter, 40.0 parts by weight of a methanol solution of tartaric acid (with a solid content of 10 wt. %) were added to the above-mentioned mixture, so that a coating liquid for second undercoat layer was prepared.

The coating liquid thus prepared was coated on the first undercoat layer, and dried at 130° C. for 20 minutes, whereby a second undercoat layer comprising the crosslinked methoxymethylated polyamide was provided with a thickness of 0.25 μm on the first undercoat layer.

[Formation of charge generation layer]

5 parts by weight of a commercially available butyral resin (Trademark "S-Lec BMS", made by Sekisui Chemical Co., Ltd.) were dissolved in 150 parts by weight of cyclohexanone. 15 parts by weight of the above-mentioned trisazo pigment of formula (22) were added to the above prepared butyral resin solution, and the resultant mixture was dispersed in a ball mill for 72 hours.

With the addition of 210 parts by weight of cyclohexanone, dispersing operation was further continued for 5 hours. Then, the mixture was diluted with cyclohexanone to have a solid content of 1.0 wt. % with stirring, so that a coating liquid for charge generation layer was prepared.

The coating liquid thus prepared was coated on the second undercoat layer by dip coating, dried at 120° C. for 10 minutes, so that a charge generation layer with a thickness of about 0.2 μm was provided on the second undercoat layer.

[Formation of charge transport layer]

The following components were mixed to prepare a coating liquid for charge transport layer:

| | Parts by Weight |
|---|---|
| Charge transport material of formula (23) | 9.0 |
| Polycarbonate resin (Trademark "Panlite C-1400", made by Teijin Chemicals Ltd.) | 10 |
| 2,5-di-tert-butyl hydroquinone | 0.03 |
| Tris(2,4-di-tert-butylphenyl)phosphite | 0.06 |
| Silicone oil (Trademark "KF-50", made by Shin-Etsu Chemical Co., Ltd.) | 0.002 |
| Methylene chloride | 85 |

The coating liquid thus prepared was coated on the charge generation layer by dip coating, and dried at 130° C. for 20 minutes, so that a charge transport layer with a thickness of 18 μm was provided on the charge generation layer.

Thus, an electrophotographic photoconductor No. 8 according to the present invention was obtained.

EXAMPLE 9

The procedure for preparation of the electrophotographic photoconductor No. 8 as in Example 8 was repeated except that the drying temperature for formation of the second undercoat layer was changed from 130 to 90° C.

Thus, an electrophotographic photoconductor No. 9 according to the present invention was obtained.

EXAMPLE 10

The procedure for preparation of the electrophotographic photoconductor No. 8 as in Example 8 was repeated except that the thickness of the second undercoat layer was changed from 0.25 to 0.005 μm.

Thus, an electrophotographic photoconductor No. 10 according to the present invention was obtained.

EXAMPLE 11

The procedure for preparation of the electrophotographic photoconductor No. 8 as in Example 8 was repeated except that the thickness of the second undercoat layer was changed from 0.25 to 1.5 μm.

Thus, an electrophotographic photoconductor No. 11 according to the present invention was obtained.

EXAMPLE 12

The procedure for preparation of the electrophotographic photoconductor No. 8 as in Example 8 was repeated except that the methoxymethylated polyamide with a methoxymethylation ratio of 30 mol % for use in the second undercoat layer coating liquid in Example 8 was replaced by a methoxymethylated polyamide with a methoxymethylation ratio of 13 mol %.

Thus, an electrophotographic photoconductor No. 12 according to the present invention was obtained.

COMPARATIVE EXAMPLE 7

The procedure for preparation of the electrophotographic photoconductor No. 8 as in Example 8 was repeated except that the tartaric acid for use in the second undercoat layer coating liquid in Example 8 was not employed, and that the drying temperature for formation of the second undercoat layer coating liquid was changed from 130 to 80° C. so as not to crosslink the methoxymethylated polyamide.

Thus, a comparative electrophotographic photoconductor No. 7 was obtained.

COMPARATIVE EXAMPLE 8

The procedure for preparation of the electrophotographic photoconductor No. 8 as in Example 8 was repeated except that the methoxymethylated polyamide for use in the second undercoat layer coating liquid in Example 8 was replaced by a commercially available copolymer polyamide (Trademark "Amilan CM-4000", made by Toray Industries, Inc.), and that the tartaric acid for use in the second undercoat layer coating liquid in Example 8 was not employed.

Thus, a comparative electrophotographic photoconductor No. 8 was obtained.

COMPARATIVE EXAMPLE 9

The procedure for preparation of the electrophotographic photoconductor No. 8 as in Example 8 was repeated except that the second undercoat layer provided in Example 8 was omitted.

Thus, a comparative electrophotographic photoconductor No. 9 was obtained.

<Image Formation Test>

Each of the electrophotographic photoconductors Nos. 8 to 12 respectively fabricated in Examples 8 to 12 and the comparative electrophotographic photoconductors Nos. 7 to 9 respectively fabricated in Comparative Examples 7 to 9 was placed in a commercially available laser printer (Trademark "SP-90", made by Ricoh Company, Ltd.).

Under the circumstances of 22° C. and 50% RH, and 10° C. and 15% RH, printing of 50,000 sheets (A4 landscape) was continuously carried out. The surface potentials of a dark portion (non-light exposed portion) (VD) and a light portion (light exposed portion) (VL) of each photoconductor were measured at the initial stage of the continuous printing operation and after printing of 50,000 sheets. The surface potentials (VD) and (VL) of each photoconductor were initially set to −900 V and −200 V, respectively when the photoconductor was installed in the laser printer under the circumstances of 220° C. and 50% RH.

Further, the obtained image qualities were visually evaluated at the initial stage and after printing of 50,000 sheets.

The results are shown in TABLE 4 and TABLE 5.

TABLE 4

Image Formation Test (22° C., 50%RH)

| | At initial stage | | | After making of 50,000 copies | | |
|---|---|---|---|---|---|---|
| | VD | VL | Image quality | VD | VL | Image quality |
| Ex. 8 | −900 V | −200 V | good | −850 V | −220 V | good |
| Ex. 9 | −900 V | −200 V | good | −850 V | −260 V | good |
| Ex. 10 | −900 V | −200 V | good | −720 V | −210 V | slight toner deposition on background (acceptable for practical use) |
| Ex. 11 | −900 V | −200 V | good | −880 V | −270 V | good |
| Ex. 12 | −900 V | −200 V | good | −850 V | −225 V | good |
| Comp. Ex. 7 | −900 V | −200 V | good | −850 V | −300 V | slight decrease of image density |
| Comp. Ex. 8 | −900 V | −200 V | good | −850 V | −280 V | slight decrease of image density |
| Comp. Ex. 9 | −900 V | −200 V | good | −610 V | −220 V | noticeable toner deposition on background |

TABLE 5

| | Image Formation Test (10° C., 15%RH) | | | | | |
|---|---|---|---|---|---|---|
| | At initial stage | | | After making of 50,000 copies | | |
| | VD | VL | Image quality | VD | VL | Image quality |
| Ex. 8 | −900 V | −230 V | good | −950 V | −220 V | good |
| Ex. 9 | −900 V | −260 V | good | −950 V | −310 V | slight decrease of image density (acceptable for practical use) |
| Ex. 10 | −900 V | −220 V | good | −700 V | −220 V | slight toner deposition on background (acceptable for practical use) |
| Ex. 11 | −900 V | −250 V | good | −970 V | −300 V | slight decrease of image density (acceptable for practical use) |
| Ex. 12 | −900 V | −230 V | good | −950 V | −255 V | good |
| Comp. Ex. 7 | −900 V | −400 V | good | −950 V | −550 V | decrease of image density |
| Comp. Ex. 8 | −900 V | −300 V | good | −1000 V | −400 V | decrease of image density |
| Comp. Ex. 9 | −900 V | −220 V | good | −600 V | −220 V | noticeable toner deposition on background |

Regardless of the ambient conditions, the electrophotographic photoconductors No. 8 to No. 12 according to the present invention produced good image quality. When each of the comparative photoconductors No. 7 to No. 9 was employed, abnormal images appeared after continuous printing operation, in particular, under the circumstances of low temperature and humidity. The comparative photoconductor No. 9 which was not provided with the second undercoat layer caused the problem of toner deposition on the background under both ambient conditions. Under the circumstances of low temperature and humidity as given in TABLE 5, the photoconductors No. 8 to No. 12 according to the present invention showed the surface potentials (VL) ranging from −220 to 310 V after printing operation. In this case, when the initial surface potential (VL) was compared with the surface potential after printing operation in terms of the absolute value, the change in surface potential (VL) was in the range of −10 to 50 V. In contrast to this, the surface potentials (VL) of the comparative photoconductors No. 7 and No. 8 were changed by 150 V and 100 V, respectively. Namely, the photoconductor of the present invention is considered to have improved durability, and the surface potential of the light exposed portion can be prevented from increasing even after the photoconductor is repeatedly used.

EXAMPLE 13

The procedure for preparation of the electrophotographic photoconductor No. 8 as in Example 8 was repeated except that the aluminum drum used as the electroconductive support in Example 8 was replaced by an electromolded nickel belt prepared in a hollow cylindrical form with an inner diameter of 60 mm.

Thus, an electrophotographic photoconductor No. 13 according to the present invention was obtained.

The adhesion of the photoconductive layer to the second undercoat layer was evaluated by the cross cut tape test defined in JIS K 5400 (8.5.2). A test piece of the photoconductor No. 13 was prepared and cut flaws reaching the support passing through the charge transport layer, the charge generation layer, the second undercoat layer, and the first undercoat layer were attached in cross-cut condition. A pressure sensitive adhesive tape was caused to adhere to the squares, and the adhering condition of the charge generation layer to the second undercoat layer was visually observed after the tape was peeled off.

As a result, each cut flaw was fine, and its both sides were smooth. There was no peeling at each intersecting point of cut flaws, and each square cut was free from peeling. Namely, the evaluation point number was 10 according to the cross-cut adhesion test.

EXAMPLE 14

The procedure for preparation of the electrophotographic photoconductor No. 12 as in Example 12 was repeated except that the aluminum drum used as the electroconductive support in Example 12 was replaced by an electromolded nickel belt prepared in a hollow cylindrical form with an inner diameter of 60 mm.

Thus, an electrophotographic photoconductor No. 14 according to the present invention was obtained. The adhesion of the photoconductive layer to the second undercoat layer was evaluated by the cross cut tape test defined in JIS K 5400 in the same manner as in Example 13. As a result, there was a slight peeling at the intersecting points of cut flaws, but each square cut was free from peeling, and the area of loss part was within 5% of all square area. Namely, the point number was evaluated as 8 points according to the cross-cut adhesion test.

When the photoconductor No. 13 was compared with the photoconductor No. 14, the peeling resistance of the photoconductor No. 13 was superior to that of the photoconductor No. 14. This is because the methoxymethylation ratio of the methoxymethylated polyamide for use in the second undercoat layer is as high as 30 mol % in the photoconductor No. 13. The higher the methoxymethylation ratio, the more improved the adhesion of the photoconductive layer.

EXAMPLE 15

[Formation of first undercoat layer]

150 parts by weight of a commercially available alkyd resin (Trademark "Beckolite M6401-50", made by Dainippon Ink & Chemicals, Incorporated) with a solid content of 50 wt. %, and 85 parts by weight of a commercially available melamine resin (Trademark "Super Beckamine L-105-60", made by Dainippon Ink & Chemicals, Incorporated) with a nonvolatile content of 60 wt. % were dissolved in 500 parts by weight of methyl ethyl ketone.

With the addition of 650 parts by weight of titanium oxide particles (Trademark "CR-EL", made by Ishihara Sangyo Kaisha, Ltd.), the resultant mixture was dispersed in a ball mill for 72 hours. Thus, a coating liquid for first undercoat layer was prepared.

The coating liquid thus prepared was coated on the outer surface of an aluminum drum with a diameter of 30 mm and a length of 301 mm, and dried at 130° C. for 20 minutes. Thus, a first undercoat layer with a thickness of 3.5 μm was provided on the aluminum drum.

[Formation of second undercoat layer]

50 parts by weight of a methoxymethylated polyamide (with a methoxymethylation ratio of 32 mol %) and 50 parts by weight of a commercially available melamine resin (Trademark "Sumitex Resin M-3", made by Sumitomo Chemical Co., Ltd.) were dissolved in a mixed solvent of 800 parts by weight of methanol and 250 parts by weight of n-butanol. Thereafter, 60.0 parts by weight of a methanol solution of tartaric acid (with a solid content of 10 wt. %) were added to the above-mentioned mixture, so that a coating liquid for second undercoat layer was prepared.

The coating liquid thus prepared was coated on the first undercoat layer, and dried at 130° C. for 20 minutes, whereby a second undercoat layer with a thickness of 0.3 μm was provided on the first undercoat layer.

[Formation of charge generation layer]

5 parts by weight of a commercially available butyral resin (Trademark "S-Lec BMS", made by Sekisui Chemical Co., Ltd.) were dissolved in 150 parts by weight of cyclohexanone. 15 parts by weight of the above-mentioned trisazo pigment of formula (22) were added to the above prepared butyral resin solution, and the resultant mixture was dispersed in a ball mill for 72 hours.

With the addition of 210 parts by weight of cyclohexanone, dispersing operation was further continued for 5 hours. Then, the mixture was diluted with cyclohexanone to have a solid content of 1.0 wt. % with stirring, so that a coating liquid for charge generation layer was prepared.

The coating liquid thus prepared was coated on the second undercoat layer by dip coating, dried at 120° C. for 10 minutes, so that a charge generation layer with a thickness of about 0.3 μm was provided on the second undercoat layer.

[Formation of charge transport layer]

The following components were mixed to prepare a coating liquid for charge transport layer:

| | Parts by Weight |
|---|---|
| Charge transport material of formula (24) | 9.5 |
| Polycarbonate resin (Trademark "Panlite C-1400", made by Teijin Chemicals Ltd.) | 10 |
| 2,5-di-tert-butyl hydroquinone | 0.02 |
| Tris(2,4-di-tert-butylphenyl)phosphite | 0.08 |

-continued

| | Parts by Weight |
|---|---|
| Silicone oil (Trademark "KF-50", made by Shin-Etsu Chemical Co., Ltd.) | 0.002 |
| Methylene chloride | 85 |

The coating liquid thus prepared was coated on the charge generation layer by dip coating, and dried at 130° C. for 20 minutes, so that a charge transport layer with a thickness of 20 μm was provided on the charge generation layer.

Thus, an electrophotographic photoconductor No. 15 according to the present invention was obtained.

EXAMPLE 16

The procedure for preparation of the electrophotographic photoconductor No. 15 as in Example 15 was repeated except that the drying temperature for formation of the second undercoat layer was changed from 130 to 850° C.

Thus, an electrophotographic photoconductor No. 16 according to the present invention was obtained.

EXAMPLE 17

The procedure for preparation of the electrophotographic photoconductor No. 15 as in Example 15 was repeated except that the thickness of the second undercoat layer was changed from 0.3 to 0.004 μm.

Thus, an electrophotographic photoconductor No. 17 according to the present invention was obtained.

EXAMPLE 18

The procedure for preparation of the electrophotographic photoconductor No. 15 as in Example 15 was repeated except that the thickness of the second undercoat layer was changed from 0.3 to 1.7 μm.

Thus, an electrophotographic photoconductor No. 18 according to the present invention was obtained.

EXAMPLE 19

The procedure for preparation of the electrophotographic photoconductor No. 15 as in Example 15 was repeated except that the methoxymethylated polyamide with a methoxymethylation ratio of 32 mol % for use in the second undercoat layer coating liquid in Example 15 was replaced by a methoxymethylated polyamide with a methoxymethylation ratio of 12.5 mol %.

Thus, an electrophotographic photoconductor No. 19 according to the present invention was obtained.

COMPARATIVE EXAMPLE 10

The procedure for preparation of the electrophotographic photoconductor No. 15 as in Example 15 was repeated except that the tartaric acid for use in the second undercoat layer coating liquid in Example 15 was not employed, and that the drying temperature for formation of the second undercoat layer was changed from 130 to 70° C. so as not to crosslink the mixture of the methoxymethylated polyamide and the melamine resin used for the formation of the second undercoat layer in

EXAMPLE 15

Thus, a comparative electrophotographic photoconductor No. 10 was obtained.

COMPARATIVE EXAMPLE 11

The procedure for preparation of the electrophotographic photoconductor No. 15 as in Example 15 was repeated except that the methoxymethylated polyamide for use in the second undercoat layer coating liquid in Example 15 was replaced by a commercially available copolymer polyamide (Trademark "Amilan CM-4000", made by Toray Industries, Inc.), and that the tartaric acid for use in the second undercoat layer coating liquid in Example 15 was not employed.

Thus, a comparative electrophotographic photoconductor No. 11 was obtained.

COMPARATIVE EXAMPLE 12

The procedure for preparation of the electrophotographic photoconductor No. 15 as in Example 15 was repeated except that the second undercoat layer provided in Example 15 was omitted.

Thus, a comparative electrophotographic photoconductor No. 12 was obtained.

<Image Formation Test>

Each of the electrophotographic photoconductors Nos. 15 to 19 respectively fabricated in Examples 15 to 19 and the comparative electrophotographic photoconductors Nos. 10 to 12 respectively fabricated in Comparative Examples 10 to 12 was placed in a commercially available facsimile machine (Trademark "BL-100", made by Ricoh Company, Ltd.).

Under the circumstances of 22° C. and 50% RH, and 10° C. and 15% RH, printing of 50,000 sheets (A4 landscape) was continuously carried out. The surface potentials of a dark portion) (VD) and a light portion (light exposed portion (VL) of each photoconductor were measured at the initial stage and after printing of 50,000 sheets under both ambient conditions. The surface potentials VD and VL were initially set to −800 V and −200 V, respectively when the photoconductor was set in the facsimile machine under the circumstances of 22° C. and 50% RH.

Further, the obtained image qualities were visually evaluated.

The results are shown in TABLE 6 and TABLE 7.

TABLE 6

Image Formation Test (22° C., 50%RH)

| | At initial stage | | | After making of 50,000 copies | | |
|---|---|---|---|---|---|---|
| | VD | VL | Image quality | VD | VL | Image quality |
| Ex. 15 | −800 V | −200 V | good | −750 V | −240 V | good |
| Ex. 16 | −800 V | −200 V | good | −750 V | −280 V | slight toner deposition on background (acceptable for practical use) |
| Ex. 17 | −800 V | −200 V | good | −680 V | −230 V | slight toner deposition on background (acceptable for practical use) |
| Ex. 18 | −800 V | −200 V | good | −780 V | −285 V | good |
| Ex. 19 | −800 V | −200 V | good | −750 V | −245 V | good |
| Comp. Ex. 10 | −800 V | −200 V | good | −750 V | −330 V | slight decrease of image density |
| Comp. Ex. 11 | −800 V | −200 V | good | −750 V | −300 V | slight decrease of image density |
| Comp. Ex. 12 | −800 V | −200 V | good | −600 V | −240 V | noticeable toner deposition on background |

TABLE 7

Image Formation Test (10° C., 15%RH)

| | At initial stage | | | After making of 50,000 copies | | |
|---|---|---|---|---|---|---|
| | VD | VL | Image quality | VD | VL | Image quality |
| Ex. 15 | −800 V | −230 V | good | −780 V | −280 V | good |
| Ex. 16 | −800 V | −260 V | good | −750 V | −330 V | slight decrease of image density (acceptable for practical use) |
| Ex. 17 | −800 V | −220 V | good | −680 V | −230 V | slight toner deposition on background |

TABLE 7-continued

| | Image Formation Test (10° C., 15%RH) | | | | | |
|---|---|---|---|---|---|---|
| | At initial stage | | | After making of 50,000 copies | | |
| | VD | VL | Image quality | VD | VL | Image quality |
| | | | | | | (acceptable for practical use) |
| Ex. 18 | −800 V | −250 V | good | −770 V | −330 V | slight decrease of image density (acceptable for practical use) |
| Ex. 19 | −800 V | −230 V | good | −750 V | −285 V | good |
| Comp. Ex. 10 | −800 V | −400 V | good | −780 V | −580 V | decrease of image density |
| Comp. Ex. 11 | −800 V | −300 V | good | −810 V | −450 V | decrease of image density |
| Comp. Ex. 12 | −800 V | −220 V | good | −600 V | −250 V | noticeable toner deposition on background |

As is apparent from the results shown in TABLE 6 and TABLE 7, the image qualities obtained by the photoconductors of the present invention were satisfactory or acceptable for practical use under both ambient conditions. In contrast to this, when the comparative photoconductors were employed, abnormal images occurred after repeated use, particularly under the circumstances of low temperature and humidity. The comparative photoconductor No. 12 which was not provided with the second undercoat layer caused the problem of toner deposition on the background under both ambient conditions. Under the circumstance of low temperature and humidity, the changes in surface potential (VL) of the photoconductors No. 15 to No. 19 according to the present invention range from 10 to 80 V after printing operation, while the surface potentials (VL) of the comparative photoconductors No. 10 and No. 11 were changed by as much as 180 and 150 V, respectively. Namely, the photoconductor of the present invention is considered to have improved durability, and the surface potential of the light exposed portion can be prevented from increasing even after repeated use.

EXAMPLE 20

The procedure for preparation of the electrophotographic photoconductor No. 15 as in Example 15 was repeated except that the aluminum drum used as the electroconductive support in Example 15 was replaced by an electromolded nickel belt prepared in a hollow cylindrical form with an inner diameter of 80 mm.

Thus, an electrophotographic photoconductor No. 20 according to the present invention was obtained.

The adhesion of the photoconductive layer to the second undercoat layer was evaluated by the cross cut tape test defined in JIS K 5400 in the same manner as in Example 13. As a result, the point number was evaluated as 10 points according to the cross-cut adhesion test.

EXAMPLE 21

The procedure for preparation of the electrophotographic photoconductor No. 19 as in Example 19 was repeated except that the aluminum drum used as the electroconductive support in Example 19 was replaced by an electromolded nickel belt prepared in a hollow cylindrical form with an inner diameter of 80 mm.

Thus, an electrophotographic photoconductor No. 21 according to the present invention was obtained.

The adhesion of the photoconductive layer to the second undercoat layer was evaluated by the cross cut tape test defined in JIS K 5400 in the same manner as in Example 13. As a result, the point number was evaluated as 8 points according to the cross-cut adhesion test.

When the photoconductor No. 20 was compared with the photoconductor No. 21, the peeling resistance of the photoconductor No. 20 was superior to that of the photoconductor No. 21. This is because the methoxymethylation ratio of the methoxymethylated polyamide for use in the second undercoat layer is as high as 32 mol % in the photoconductor No. 20. The higher the methoxymethylation ratio, the more improved the adhesion of the photoconductive layer.

EXAMPLE 22

[Formation of undercoat layer]

30 parts by weight of a methoxymethylated polyamide (with a methoxymethylation ratio of 28 mol %) and 50 parts by weight of a commercially available methylated melamine resin (Trademark "Super Beckamine L-105-60", made by Dainippon Ink & Chemicals, Incorporated) with a nonvolatile content of 60 wt. % were dissolved in 500 parts by weight of methanol. With the addition of 250 parts by weight of untreated titanium oxide particles with a purity of 99.7 wt. % (Trademark "CR-EL", made by Ishihara Sangyo Kaisha, Ltd.), the resultant mixture was dispersed in a ball mill for 72 hours. Thereafter, 36.0 parts by weight of a methanol solution of tartaric acid (with a solid content of 10 wt. %) were added to the above-mentioned mixture, so that a coating liquid for undercoat layer was prepared.

The coating liquid thus prepared was coated on the outer surface of an aluminum drum with a diameter of 30 mm and a length of 340 mm, and dried at 130° C. for 25 minutes. Thus, an undercoat layer with a thickness of 7.0 $\mu$m was provided on the aluminum drum.

[Formation of charge generation layer]

5 parts by weight of a commercially available butyral resin (Trademark "S-Lec BMS", made by Sekisui Chemical Co., Ltd.) were dissolved in 150 parts by weight of cyclohexanone. 15 parts by weight of the above-mentioned trisazo pigment of formula (22) were added to the above prepared butyral resin solution, and the resultant mixture was dispersed in a ball mill for 72 hours.

With the addition of 210 parts by weight of cyclohexanone, dispersing operation was further continued for 5 hours. Then, the mixture was diluted with cyclohexanone to have a solid content of 1.0 wt. % with stirring, so that a coating liquid for charge generation layer was prepared.

The coating liquid thus prepared was coated on the undercoat layer by dip coating, dried at 120° C. for 10 minutes, so that a charge generation layer with a thickness of about 0.3 μm was provided on the undercoat layer.

[Formation of charge transport layer]

The following components were mixed to prepare a coating liquid for charge transport layer:

| | Parts by Weight |
|---|---|
| Charge transport material of formula (23) | 9.0 |
| Polycarbonate resin (Trademark "Panlite C-1400", made by Teijin Chemicals Ltd.) | 10.0 |
| Silicone oil (Trademark "KF-50", made by Shin-Etsu Chemical Co., Ltd.) | 0.002 |
| Methylene chloride | 85 |

The coating liquid thus prepared was coated on the charge generation layer by dip coating, and dried at 130° C. for 20 minutes, so that a charge transport layer with a thickness of 26 μm was provided on the charge generation layer.

Thus, an electrophotographic photoconductor No. 22 according to the present invention was obtained.

EXAMPLE 23

The procedure for preparation of the electrophotographic photoconductor No. 22 as in Example 22 was repeated except that the untreated titanium oxide particles for use in the undercoat layer coating liquid in Example 22 were replaced by commercially available untreated titanium oxide particles (Trademark "KA-20", made by Titan Kogyo K.K.) with a purity of 96.0 wt. %.

Thus, an electrophotographic photoconductor No. 23 according to the present invention was obtained.

COMPARATIVE EXAMPLE 13

The procedure for preparation of the electrophotographic photoconductor No. 22 as in Example 22 was repeated except that the tartaric acid for use in the undercoat layer coating liquid in Example 22 was not employed, and that the drying temperature for formation of the undercoat layer was changed from 130 to 95° C. so as not to crosslink the mixture of the methoxymethylated polyamide and the methylated melamine resin used for the formation of the undercoat layer in Example 22.

Thus, a comparative electrophotographic photoconductor No. 13 was obtained.

<Image Formation Test>

Each of the electrophotographic photoconductors Nos. 22 and 23 respectively fabricated in Examples 22 and 23 and the comparative electrophotographic photoconductor No. 13 fabricated in Comparative Example 13 was placed in a commercially available copying machine (Trademark "IMAGIO MF-200", made by Ricoh Company, Ltd.) where a contact type charger in the form of a roller and reversal development system were adapted.

Under the circumstances of 22° C. and 50% RH, 10° C. and 15% RH, and 30° C. and 90% RH, 12,000 copies (A4 landscape) were continuously made. The surface potentials of a dark portion (non-light exposed portion) (VD) and a light portion (light exposed portion) (VL) of each photoconductor were measured at the initial stage of the continuous copying operation and after making of 12,000 copies. The surface potentials (VD) and (VL) of each photoconductor were initially set to −850 V and −200 V, respectively.

Further, the obtained image qualities were visually evaluated at the initial stage and after making of 12,000 copies.

The results are shown in TABLE 8 to TABLE 10.

TABLE 8

Image Formation Test (22° C., 50%RH)

| | At initial stage | | | After making of 50,000 copies | | |
|---|---|---|---|---|---|---|
| | VD | VL | Image quality | VD | VL | Image quality |
| Ex. 22 | −850 V | −200 V | good | −880 V | −230 V | good |
| Ex. 23 | −850 V | −200 V | good | −900 V | −270 V | slight toner deposition on background (acceptable for practical use) |
| Comp. Ex. 13 | −850 V | −200 V | good | −920 V | −380 V | decrease of image density |

TABLE 9

Image Formation Test (10° C., 15%RH)

| | At initial stage | | | After making of 50,000 copies | | |
|---|---|---|---|---|---|---|
| | VD | VL | Image quality | VD | VL | Image quality |
| Ex. 22 | −850 V | −200 V | good | −900 V | −240 V | good |

TABLE 9-continued

| | Image Formation Test (10° C., 15%RH) | | | | | |
|---|---|---|---|---|---|---|
| | At initial stage | | | After making of 50,000 copies | | |
| | VD | VL | Image quality | VD | VL | Image quality |
| Ex. 23 | −850 V | −200 V | good | −910 V | −285 V | slight decrease of image density (acceptable for practical use) |
| Comp. Ex. 13 | −850 V | −200 V | good | −930 V | −425 V | decrease of image density |

TABLE 10

| | Image Formation Test (30° C., 90%RH) | | | | | |
|---|---|---|---|---|---|---|
| | At initial stage | | | After making of 12,000 copies | | |
| | VD | VL | Image quality | VD | VL | Image quality |
| Ex. 22 | −850 V | −200 V | good | −900 V | −220 V | good |
| Ex. 23 | −850 V | −200 V | good | −910 V | −275 V | slight decrease of image density (acceptable for practical use) |
| Comp. Ex. 13 | −850 V | −200 V | good | −950 V | −550 V | decrease of image density |

Regardless of the ambient conditions, the electrophotographic photoconductors No. 22 and No. 23 according to the present invention produced good image quality. When the comparative photoconductor No. 13 was employed, the decrease in image density was observed after repeated use under any ambient conditions. The surface potentials (VL: −200 V) of the photoconductors No. 22 and No. 23 according to the present invention ranged from −220 to −285 V after making of 12,000 copies under any of the above-mentioned ambient conditions, while the surface potentials (VL: −200 V) of the comparative photoconductor No. 13 were changed up to −550 V depending upon the ambient conditions after making of continuous copies. Namely, the photoconductor of the present invention is considered to be less dependent upon the ambient conditions. The increase in surface potential of the light exposed portion caused by the repeated operation, that is, deterioration of the photoconductor properties can be prevented. Furthermore, the test results of the photoconductor No. 22 were better than those of the photoconductor No. 23. This results from high purity of titanium oxide particles for use in the undercoat layer coating liquid in Example 22.

EXAMPLE 24

[Formation of undercoat layer]

49 parts by weight of a methoxymethylated polyamide (with a methoxymethylation ratio of 33 mol %) and 35 parts by weight of a commercially available butylated melamine resin (Trademark "Super Beckamine G-821-60", made by Dainippon Ink & Chemicals, Incorporated) with a nonvolatile content of 60 wt. % were dissolved in a mixed solvent of 360 parts by weight of methanol and 100 parts by weight of n-butanol. With the addition of 420 parts by weight of untreated titanium oxide particles with a purity of 98.0 wt. % (Trademark "TA-300", made by Fuji Titanium Industry Co., Ltd.), the resultant mixture was dispersed in a ball mill for 100 hours. Thereafter, 22 parts by weight of a methanol solution of hypophosphorous acid (with a solid content of 10 wt. %) were added to the above-mentioned mixture, so that a coating liquid for undercoat layer was prepared.

The coating liquid thus prepared was coated on the outer surface of an aluminum drum with a diameter of 80 mm and a length of 360 mm, and dried at 125° C. for 30 minutes. Thus, an undercoat layer with a thickness of 3.5 μm was provided on the aluminum drum.

[Formation of charge generation layer]

4 parts by weight of a commercially available butyral resin (Trademark "S-Lec BMS", made by Sekisui Chemical Co., Ltd.) were dissolved in 150 parts by weight of cyclohexanone. 16 parts by weight of the above-mentioned trisazo pigment of formula (22) were added to the above prepared butyral resin solution, and the resultant mixture was dispersed in a ball mill for 72 hours.

With the addition of 210 parts by weight of cyclohexanone, dispersing operation was further continued for 5 hours. Then, the mixture was diluted with cyclohexanone to have a solid content of 1.0 wt. % with stirring, so that a coating liquid for charge generation layer was prepared.

The coating liquid thus prepared was coated on the undercoat layer by dip coating, dried at 120° C. for 10 minutes, so that a charge generation layer with a thickness of about 0.3 μm was provided on the undercoat layer.

[Formation of charge transport layer]

The following components were mixed to prepare a coating liquid for charge transport layer:

| | Parts by Weight |
|---|---|
| Charge transport material of formula (24) | 9.5 |
| Polycarbonate resin (Trademark "Panlite K-1300", made by Teijin Chemicals Ltd.) | 10 |
| Silicone oil (Trademark "KF-50", made by Shin-Etsu Chemical Co., Ltd.) | 0.002 |
| Methylene chloride | 85 |

The coating liquid thus prepared was coated on the charge generation layer by dip coating, and dried at 130° C. for 20 minutes, so that a charge transport layer with a thickness of 20 μm was provided on the charge generation layer.

Thus, an electrophotographic photoconductor No. 24 according to the present invention was obtained.

EXAMPLE 25

The procedure for preparation of the electrophotographic photoconductor No. 24 as in Example 24 was repeated except that the methoxymethylated polyamide with a methoxymethylation ratio of 33 mol % for use in the undercoat layer coating liquid in Example 24 was replaced by a methoxymethylated polyamide with a methoxymethylation ratio of 14 mol %.

Thus, an electrophotographic photoconductor No. 25 according to the present invention was obtained.

EXAMPLE 26

The procedure for preparation of the electrophotographic photoconductor No. 24 as in Example 24 was repeated except that the drying temperature for formation of the undercoat layer was changed from 125 to 90° C.

Thus, an electrophotographic photoconductor No. 26 according to the present invention was obtained.

COMPARATIVE EXAMPLE 14

The procedure for preparation of the electrophotographic photoconductor No. 25 as in Example 25 was repeated except that the hypophosphorous acid for use in the undercoat layer coating liquid in Example 25 was not employed, and that the drying temperature for formation of the undercoat layer was changed from 125 to 90° C. so as not to crosslink the mixture of the methoxymethylated polyamide and the butylated melamine resin used for the formation of the undercoat layer in Example 25.

Thus, a comparative electrophotographic photoconductor No. 14 was obtained.

<Image Formation Test>

Each of the electrophotographic photoconductors Nos. 24 to 26 respectively fabricated in Examples 24 to 26 and the comparative electrophotographic photoconductor No. 14 fabricated in Comparative Example 14 was placed in a commercially available copying machine (Trademark "IMAGIO 420V", made by Ricoh Company, Ltd.) which was modified as shown below.

Charging method: contact charging by use of a roller

Initial VD: −600 V

Initial VL: −150 V

Developing bias: −400 V

Developing method: reversal development

Under the circumstances of 20° C. and 52% RH, 3,000 copies (A4 landscape) were continuously made. The image qualities obtained at the initial stage and after making of 3,000 copies were visually evaluated.

The results are shown in TABLE 11.

TABLE 11

| | Initial Image Quality | Image Quality after Making of 3,000 copies |
|---|---|---|
| Ex. 24 | good | good |
| Ex. 25 | good | slight toner deposition on background (acceptable for practical use) |
| Ex. 26 | good | slight decrease of image density (acceptable for practical use) |
| Comp. Ex. 14 | good | decrease of image density |

As is apparent from the results shown in TABLE 11, the image qualities obtained by the photoconductors No. 24 to No. 26 were satisfactory or acceptable for practical use even after making of 3,000 copies. In contrast to this, the image density was decreased as the comparative photoconductor No. 14 was repeatedly used. It is confirmed that the photoconductors of the present invention can be prevented from deteriorating even after repeated use.

Further, since the methoxymethylation ratio of the methoxymethylated polyamide for use in the undercoat layer was as high as 33 mol % in Example 24, the durability of the obtained photoconductor No. 24 was superior to that of the photoconductor No. 25.

EXAMPLE 27

The procedure for preparation of the electrophotographic photoconductor No. 24 as in Example 24 was repeated except that an aluminum drum with a diameter of 30 mm and a length of 340 mm was used as the electroconductive support, and that the thickness of the charge transport layer was changed from 20 to 15 μm.

Thus, an electrophotographic photoconductor No. 27 according to the present invention was obtained.

COMPARATIVE EXAMPLE 15

The procedure for preparation of the electrophotographic photoconductor No. 27 as in Example 27 was repeated except that the hypophosphorous acid for use in the undercoat layer coating liquid in Example 27 was not employed, and that the drying temperature for formation of the undercoat layer was changed from 125 to 95° C. so as not to crosslink the mixture of the methoxymethylated polyamide and the butylated melamine resin used for the formation of the undercoat layer in Example 27, and that the thickness of the undercoat layer was changed from 3.5 to 0.3 μm.

Thus, a comparative electrophotographic photoconductor No. 15 was obtained.

COMPARATIVE EXAMPLE 16

The procedure for preparation of the electrophotographic photoconductor No. 27 as in Example 27 was repeated except that the hypophosphorous acid for use in the undercoat layer coating liquid in Example 27 was not employed, and that the drying temperature for formation of the undercoat layer was changed from 125 to 95° C. so as not to crosslink the mixture of the methoxymethylated polyamide and the butylated melamine resin used for the formation of the undercoat layer in Example 27, and that the thickness of the undercoat layer was changed from 3.5 to 7.0 μm.

Thus, a comparative electrophotographic photoconductor No. 16 was obtained.

COMPARATIVE EXAMPLE 17

The procedure for preparation of the electrophotographic photoconductor No. 27 as in Example 27 was repeated except that the titanium oxide particles for use in the undercoat layer coating liquid in Example 27 were not employed, and that the thickness of the undercoat layer was changed from 3.5 to 0.3 μm.

Thus, a comparative electrophotographic photoconductor No. 17 was obtained.

COMPARATIVE EXAMPLE 18

The procedure for preparation of the electrophotographic photoconductor No. 27 as in Example 27 was repeated except that the titanium oxide particles for use in the undercoat layer coating liquid in Example 27 were not employed, and that the thickness of the undercoat layer was changed from 3.5 to 2.0 μm.

Thus, a comparative electrophotographic photoconductor No. 18 was obtained.

<Image Formation Test>

Each of the electrophotographic photoconductor No. 27 fabricated in Example 27 and the comparative electrophotographic photoconductors Nos. 15 to 18 respectively fabricated in Comparative Examples 15 to 18 was placed in a commercially available copying machine (Trademark "IMAGIO MF-2200M", made by Ricoh Company, Ltd.) where a contact type charger in the form of a roller and reversal development system were adapted.

The surface potentials of a dark portion (non-light exposed portion) (VD) and a light portion (light exposed portion) (VL) of each photoconductor were initially set to −600 V and −100 V, respectively, and the developing bias was set to −450 V.

Under the circumstances of 20° C. and 52% RH, 1,000 copies (A4 landscape) were continuously made. The image qualities obtained at the initial stage and after making of 1,000 copies were visually evaluated.

The results are shown in TABLE 12.

TABLE 12

| | Initial Image Quality | Image Quality after Making of 1,000 copies |
|---|---|---|
| Ex. 27 | good | good |
| Comp. Ex. 15 | good | numerous black spots due to discharge breakdown |
| Comp. Ex. 16 | good | decrease of image density |
| Comp. Ex. 17 | good | numerous black spots due to discharge breakdown |
| Comp. Ex. 18 | good | decrease of image density |

As is apparent from the results shown in TABLE 12, the photoconductor No. 27 produced satisfactory images after continuous making of copies. In contrast to this, there appeared abnormal images after making of copies when the comparative photoconductors Nos. 15 and 16 were employed. The comparative photoconductors Nos. 17 and 18 in which no titanium oxide was contained in the undercoat layer caused abnormal images after making of copies. The comparative photoconductors Nos. 15 and 17 had a considerably thin undercoat layer, so that discharge breakdown took place. The deterioration of the photoconductor caused by repeated use can be effectively controlled by the present invention.

EXAMPLE 28

[Preparation of Undercoat Layer Coating Liquid]

A coating liquid for undercoat layer was prepared by the following method.

30 parts by weight of a methoxymethylated polyamide (Trademark "Fine Resin FR-102", made by Namariichi Co., Ltd.) with a methoxymethylation ratio of 30 mol %, and 50 parts by weight of a commercially available butylated melamine resin (Trademark "Super Beckamine G-821-60", made by Dainippon Ink & Chemicals, Incorporated) with a nonvolatile content of 60 wt. % were dissolved in a mixed solvent of 200 parts by weight of methanol, 50 parts by weight of n-butanol, and 250 parts by weight of methyl ethyl ketone. With the addition of 250 parts by weight of titanium oxide particles not subjected to surface treatment (Trademark "CR-EL", made by Ishihara Sangyo Kaisha, Ltd.), the resultant mixture was dispersed in a ball mill for 70 hours. Thereafter, 30.0 parts by weight of a methanol solution of hypophosphorous acid (with a solid content of 10 wt. %) were added to the above-mentioned mixture, so that a coating liquid for undercoat layer was prepared.

EXAMPLE 29

[Preparation of Undercoat Layer Coating Liquid]

The procedure for preparation of the coating liquid for undercoat layer as in Example 28 was repeated except that 30.0 parts by weight of the methanol solution of hypophosphorous acid used in Example 28 were replaced by 15.0 parts by weight of a methanol solution of boric acid (with a solid content of 10 wt. %).

Thus, a coating liquid for undercoat layer was prepared.

The dispersion stability of each of the undercoat layer coating liquids prepared in Examples 28 and 29 was evaluated by the following method. The particle size distribution of each coating liquid was analyzed to obtain the content of coarse particles with a particle size of 1.0 μm or more, using a commercially available analyzer (Trademark "CAPA-700", made by Shimadzu Corporation) immediately after the preparation of each coating liquid. After the coating liquid was stored for 40 days with stirring with a stirrer, the content of the coarse particles was obtained in the same manner as mentioned above.

The results are shown in TABLE 13.

TABLE 13

| | Content of Coarse Particles in Coating Liquid | |
|---|---|---|
| | Immediately After Preparation of Coating Liquid | After Storage for 40 Days |
| Ex. 28 | 5% | 6% |
| Ex. 29 | 3% | 4% |

As can be seen from the results shown in TABLE 13, the dispersion stability of the coating liquid was excellent even after the storage. It is considered that this is because the mixed solvent of an alcohol and a ketone is used for the preparation of the undercoat layer coating liquid, with the addition thereto of an acid catalyst.

EXAMPLE 30

Preparation of Electrophotographic Photoconductor (Formation of undercoat layer)

There were prepared in Example 28 two kinds of coating liquids for undercoat layer, that is, the dispersions immediately after prepared, and stored for 40 days with stirring. Each coating liquid was coated on the outer surface of an aluminum drum with a diameter of 30 mm and a length of 340 mm, and dried at 120° C. for 20 minutes.

Thus, an undercoat layer with a thickness of 6.0 μm was provided on the aluminum drum.

[Formation of charge generation layer]

18 parts by weight of an A-type titanyl phthalocyanine pigment were placed in a glass pot together with zirconia beads with a diameter of 2 mm. With the addition of 350 parts by weight of methyl ethyl ketone, the phthalocyanine pigment was subjected to ball milling for 15 hours. Thereafter, a resin solution prepared by dissolving 10 parts by weight of a commercially available polyvinyl butyral resin (Trademark "S-Lec BX-1", made by Sekisui Chemical Co., Ltd.) in 600 parts by weight of methyl ethyl ketone was added to the above-mentioned phthalocyanine pigment, and the resultant mixture was dispersed in a ball mill for 2 hours. Thus, a coating liquid for charge generation layer was prepared.

The coating liquid thus prepared was coated on the undercoat layer by dip coating, dried at 80° C. for 20 minutes, so that a charge generation layer with a thickness of about 0.3 μm was provided on the undercoat layer.

[Formation of charge transport layer]

The following components were mixed to prepare a coating liquid for charge transport layer:

| | Parts by Weight |
|---|---|
| Charge transport material of formula (23) | 9.0 |
| Polycarbonate resin (Trademark "Panlite C-1400", made by Teijin Chemicals Ltd.) | 10.0 |
| Silicone oil (Trademark "KF-50", made by Shin-Etsu Chemical Co., Ltd.) | 0.002 |
| Tetrahydrofuran | 80 |

The coating liquid thus prepared was coated on the charge generation layer by dip coating, and dried at 130° C. for 20 minutes, so that a charge transport layer with a thickness of 28 μm was provided on the charge generation layer.

Thus, two kinds of electrophotographic photoconductors 30*a* and 30*b* according to the present invention were obtained. The photoconductor 30*a* employed as the undercoat layer coating liquid the dispersion immediately after prepared in Example 28; while the photoconductor 30*b* employed as the undercoat layer coating liquid the dispersion stored for 40 days.

EXAMPLE 31

The procedure for preparation of the two kinds of electrophotographic photoconductors 30*a* and 30*b* as in Example 30 was repeated except that the two kinds of coating liquids for undercoat layer prepared in Example 28 were replaced by those prepared in Example 29.

Thus, two kinds of electrophotographic photo-conductors 31*a* and 31*b* according to the present invention were obtained.

<Image Formation Test>

Each of the electrophotographic photoconductors 30*a* and 30*b* fabricated in Example 30 and the electrophotographic photoconductors 31*a* and 31*b* fabricated in Example 31 was placed in a commercially available copying machine (Trademark "IMAGIO MF-200", made by Ricoh Company, Ltd.) where a contact type charger in the form of a roller and reversal development system were adapted.

The initial image quality and the image quality obtained after making of 2,000 copies were visually evaluated. The surface potentials (VD) and (VL) of each photoconductor were initially set to −950 V and −200 V, respectively, and the developing bias was set to −600 V.

The results are shown in TABLE 14.

TABLE 14

| | Photo-conductor No. | Initial Image Quality | Image Quality after Making of 2,000 Copies |
|---|---|---|---|
| Ex. 30 | 30a | good | good |
| | 30b | good | good |
| Ex. 31 | 31a | good | good |
| | 31b | good | good |

As shown in TABLE 14, when any of the coating liquids was used for formation of the undercoat layer, the obtained photoconductor produced high quality images after making of 2,000 copies. When the undercoat layer coating liquid was prepared using a mixed solvent of an alcohol and a ketone, with the addition thereto of an acid catalyst, the photoconductor was provided with high durability.

EXAMPLE 32

Preparation of Undercoat Layer Coating Liquid

A coating liquid for undercoat layer was prepared by the following method.

60 parts by weight of a copolymer polyamide (Trademark "PLATAMIDM 1276F", available from Elf Atochem Japan) were dissolved in 100 parts by weight of formic acid. The above prepared polyamide resin solution was stirred at 60° C. 60 parts by weight of paraformaldehyde were dissolved in 100 parts by weight of methanol to which an alkali was added, and the resultant methanol solution was gradually added to the polyamide resin solution with the temperature thereof being maintained at 60° C. The resultant mixture was stirred for 10 minutes. With addition of 60 parts by weight of methanol, the mixture was stirred at 60° C. for 20 minutes.

The reaction mixture thus prepared was poured into 1500 ml of a mixed solvent of acetone and water at a mixing ratio by volume of 1:1. The mixture was neutralized by adding a 30% ammonia water dropwise thereto. The precipitated product was washed with water, so that a methoxymethylated polyamide with a methoxymethylation ratio of 33 mol % was obtained. 45 parts by weight of the methoxymethylated polyamide thus obtained and 25 parts by weight of a commercially available butylated melamine resin (Trademark "Super Beckamine L-110-60", made by Dainippon Ink & Chemicals, Incorporated) with a nonvolatile content of 60 wt. % were dissolved in a mixed solvent of 300 parts by weight of methanol and 150 parts by weight of methyl ethyl ketone. With the addition of 330 parts by weight of titanium oxide particles (Trademark "TA-300", made by Fuji Titanium Industry Co., Ltd.), the resultant mixture was dispersed in a ball mill for 100 hours. Thereafter, 18.0 parts by weight of a methanol solution of boric acid (with a solid content of 10 wt. %) were added to the above-mentioned mixture, so that a coating liquid for undercoat layer was prepared.

The methoxymethylation ratio of the above-mentioned methoxymethylated polyamide resin was obtained in such a manner that an 18% methanol solution of the sample resin was coated on a rock salt plate to form a thin film thereon, and the IR absorption spectrum of the thin film was measured. Then, the methoxymethylation ratio was calculated from the peak ratio of 1080 $cm^{-1}$/1370 $cm^{-1}$.

EXAMPLE 33

Preparation of Undercoat Layer Coating Liquid

The procedure for preparation of the coating liquid for undercoat layer as in Example 32 was repeated except that the methoxymethylation ratio of the methoxymethylated polyamide obtained in Example 32 was changed from 33 to 12 mol % by controlling the modifying conditions.

Thus, a coating liquid for undercoat layer was prepared.

EXAMPLE 34

Preparation of Undercoat Layer Coating Liquid

The procedure for preparation of the coating liquid for undercoat layer as in Example 32 was repeated except that the methoxymethylation ratio of the methoxymethylated polyamide obtained in Example 32 was changed from 33 to 15 mol % by controlling the modifying conditions.

Thus, a coating liquid for undercoat layer was prepared.

EXAMPLE 35

Preparation of Undercoat Layer Coating Liquid

The procedure for preparation of the coating liquid for undercoat layer as in Example 32 was repeated except that the commercially available butylated melamine resin (Trademark "Super Beckamine L-110-60", made by Dainippon Ink & Chemicals, Incorporated) used in Example 32 was replaced by the commercially available methylated melamine resin (Trademark "Super Beckamine L-105-60", made by Dainippon Ink & Chemicals, Incorporated) with a nonvolatile content of 60 wt. %.

The dispersion stability of each of the undercoat layer coating liquids prepared in Examples 32 to 35 was evaluated by the following method. The particle size distribution of each coating liquid was analyzed to obtain the content of coarse particles with a particle size of 1.0 $\mu$m or more, using a commercially available analyzer (Trademark "CAPA-700", made by Shimadzu Corporation) immediately after the preparation of each coating liquid. After the coating liquid was stored for 2 months with stirring with a stirrer, the content of the coarse particles was obtained in the same manner as mentioned above.

The results are shown in TABLE 15.

TABLE 15

| | Content of Coarse Particles in Coating Liquid | |
|---|---|---|
| | Immediately After Preparation of Coating Liquid | After Storage for 2 Months |
| Ex. 32 | 4% | 6% |
| Ex. 33 | 9% | 26% |
| Ex. 34 | 7% | 10% |
| Ex. 35 | 4% | 25% |

As can be seen from the results shown in TABLE 15, drastic deterioration of the dispersion stability was not observed after storage of 2 months with respect to the coating liquids prepared in Examples 32 to 35. It is confirmed that the coating liquid for undercoat layer used for the fabrication of the electrophotographic photoconductor is excellent in terms of the dispersion stability.

EXAMPLE 36

Preparation of Electrophotographic Photoconductor (Formation of undercoat layer)

There were prepared in Example 32 two kinds of coating liquids for undercoat layer, that is, the dispersions immediately after prepared, and stored for 2 months with stirring. Each coating liquid was coated on the outer surface of an aluminum drum with a diameter of 80 mm and a length of 360 mm, and dried at 110° C. for 30 minutes.

Thus, an undercoat layer with a thickness of 4.0 $\mu$m was provided on the aluminum drum.

[Formation of charge generation layer]

4 parts by weight of a commercially available butyral resin (Trademark "S-Lec BMS", made by Sekisui Chemical Co., Ltd.) were dissolved in 150 parts by weight of cyclohexanone. 16 parts by weight of the above-mentioned trisazo pigment of formula (22) were added to the above prepared butyral resin solution, and the resultant mixture was dispersed in a ball mill for 72 hours.

With the addition of 210 parts by weight of cyclohexanone, dispersing operation was further continued for 5 hours. Then, the mixture was diluted with cyclohexanone to have a solid content of 1.0 wt. % with stirring, so that a coating liquid for charge generation layer was prepared.

The coating liquid thus prepared was coated on the undercoat layer by dip coating, dried at 120° C. for 10 minutes, so that a charge generation layer with a thickness of about 0.3 $\mu$m was provided on the undercoat layer.

[Formation of charge transport layer]

The following components were mixed to prepare a coating liquid for charge transport layer:

| | Parts by Weight |
|---|---|
| Charge transport material of formula (23) | 9.5 |
| Polycarbonate resin (Trademark "Panlite TS-2050", made by Teijin Chemicals Ltd.) | 10 |
| Silicone oil (Trademark "KF-50", made by Shin-Etsu Chemical Co., Ltd.) | 0.002 |
| Tetrahydrofuran | 85 |

The coating liquid thus prepared was coated on the charge generation layer by dip coating, and dried at 130° C. for 20 minutes, so that a charge transport layer with a thickness of 28 $\mu$m was provided on the charge generation layer.

Thus, two kinds of electrophotographic photoconductors 36*a* and 36*b* according to the present invention were obtained. The photoconductor 36*a* employed as the undercoat layer coating liquid the dispersion immediately after prepared in Example 32; while the photoconductor 36*b* employed as the undercoat layer coating liquid the dispersion stored for two months.

EXAMPLE 37

The procedure for preparation of the two kinds of electrophotographic photoconductors 36*a* and 36*b* as in Example 36 was repeated except that the two kinds of coating liquids for undercoat layer prepared in Example 32 were replaced by those prepared in Example 33.

Thus, two kinds of electrophotographic photoconductors 37*a* and 37*b* according to the present invention were obtained.

EXAMPLE 38

The procedure for preparation of the two kinds of electrophotographic photoconductors 36*a* and 36*b* as in Example 36 was repeated except that the two kinds of coating liquids for undercoat layer prepared in Example 32 were replaced by those prepared in Example 34.

Thus, two kinds of electrophotographic photoconductors 38*a* and 38*b* according to the present invention were obtained.

EXAMPLE 39

The procedure for preparation of the two kinds of electrophotographic photoconductors 36*a* and 36*b* as in Example 36 was repeated except that the two kinds of coating liquids for undercoat layer prepared in Example 32 were replaced by those prepared in Example 35.

Thus, two kinds of electrophotographic photoconductors 39*a* and 39*b* according to the present invention were obtained.

<Image Formation Test>

Each of the electrophotographic photoconductors 36*a* and 36*b* fabricated in Example 36, photoconductors 37*a* and 37*b* fabricated in Example 37, photoconductors 38*a* and 38*b* fabricated in Example 38, and photoconductors 39*a* and 39*b* fabricated in Example 39 was placed in a commercially available copying machine (Trademark "IMAGIO 420V", made by Ricoh Company, Ltd.) which was modified as shown below. Charging method: contact charging by use of a roller Initial VD: −600 V Initial VL: −180 V Developing bias: −400 V Developing method: reversal development Under the circumstances of 20° C. and 52% RH, 3,000 copies were continuously made. The image qualities obtained at the initial stage and after making of 3,000 copies were visually evaluated.

The results are shown in TABLE 16.

TABLE 16

| | Photo-conductor No. | Initial Image Quality | Image Quality after Making of 3,000 Copies |
|---|---|---|---|
| Ex. 36 | 36a | good | good |
| | 36b | good | good |
| Ex. 37 | 37a | good | good |
| | 37b | slightly poor graininess (acceptable for practical use) | slightly poor graininess (acceptable for practical use) |
| Ex. 38 | 38a | good | good |
| | 38b | good | good |
| Ex. 39 | 39a | good | good |
| | 39b | slightly poor graininess (acceptable for practical use) | slightly poor graininess (acceptable for practical use) |

According to the measurement of particle size distribution of the coating liquids prepared in Examples 32 to 35, slight decrease in dispersion stability was observed in the coating liquids after storage for 2 months. However, even though the photoconductors were fabricated using such undercoat layer coating liquids, the image quality obtained after making of copies was acceptable for practical use as shown in TABLE 16. In other words, according to the method for producing the photoconductor of the present invention, the undercoat layer coating liquid can be used even after stored for a long time.

EXAMPLE 40

[Formation of undercoat layer]

15 parts by weight of a commercially available methoxymethylated polyamide (Trademark "Toresin F30K" made by Teikoku Chemical Industries Co., Ltd.) with a methoxymethylation ratio of 30 mol % and 75 parts by weight of a commercially available butylated melamine resin (Trademark "Super Beckamine G-821-60", made by Dainippon Ink & Chemicals, Incorporated) with a nonvolatile content of 60 wt. % were dissolved in a mixed solvent of 150 parts by weight of methanol, 150 parts by weight of n-butanol, and 150 parts by weight of methyl isobutyl ketone. With the addition of 200 parts by weight of untreated titanium oxide particles (Trademark "KA-20", made by Titan Kogyo K.K.), the resultant mixture was dispersed in a ball mill for 96 hours. Thereafter, 30 parts by weight of a methanol solution of malonic acid (with a solid content of 10 wt. %) were added to the above-mentioned mixture, so that a coating liquid for undercoat layer was prepared.

The coating liquid thus prepared was stored for 3 months with stirring with a stirrer. After 3 months, the coating liquid was coated on the outer surface of an aluminum drum with a diameter of 30 mm and a length of 340 mm, and dried at 115° C. for 30 minutes. Thus, an undercoat layer with a thickness of 3.0 μm was provided on the aluminum drum.

[Formation of charge generation layer]

5 parts by weight of a commercially available butyral resin (Trademark "S-Lec BMS", made by Sekisui Chemical Co., Ltd.) were dissolved in 150 parts by weight of cyclohexanone. 15 parts by weight of the above-mentioned trisazo pigment of formula (22) were added to the above prepared butyral resin solution, and the resultant mixture was dispersed in a ball mill for 72 hours.

With the addition of 210 parts by weight of cyclohexanone, dispersing operation was further continued for 5 hours. Then, the mixture was diluted with cyclohexanone to have a solid content of 1.0 wt. % with stirring, so that a coating liquid for charge generation layer was prepared.

The coating liquid thus prepared was coated on the undercoat layer by dip coating, dried at 120° C. for 10 minutes, so that a charge generation layer with a thickness of about 0.3 μm was provided on the undercoat layer.

[Formation of charge transport layer]

The following components were mixed to prepare a coating liquid for charge transport layer:

| | Parts by Weight |
|---|---|
| Charge transport material of formula (24) | 9.0 |
| Polycarbonate resin (Trademark "Panlite C-1400", made by Teijin Chemicals Ltd.) | 10.0 |
| Silicone oil (Trademark "KF-50", made by Shin-Etsu Chemical Co., Ltd.) | 0.002 |
| Methylene chloride | 85 |

The coating liquid thus prepared was coated on the charge generation layer by dip coating, and dried at 130° C. for 20 minutes, so that a charge transport layer with a thickness of 29 μm was provided on the charge generation layer.

Thus, an electrophotographic photoconductor No. 40 according to the present invention was obtained.

EXAMPLE 41

The procedure for preparation of the electrophotographic photoconductor No. 40 as in Example 40 was repeated except that the drying temperature for formation of the undercoat layer was changed from 115 to 95° C.

Thus, an electrophotographic photoconductor No. 41 according to the present invention was obtained.

EXAMPLE 42

The procedure for preparation of the electrophotographic photoconductor No. 40 as in Example 40 was repeated except that the drying temperature for formation of the undercoat layer was changed from 115 to 185° C.

Thus, an electrophotographic photoconductor No. 42 according to the present invention was obtained.

<Image Formation Test>

Each of the electrophotographic photoconductors No. 40 to No. 42 respectively fabricated in Examples 40 to 42 was placed in a commercially available copying machine (Trademark "IMAGIO MF-2200", made by Ricoh Company, Ltd.) where a contact type charger in the form of a roller and reversal development system were adapted.

The surface potentials (VD) and (VL) of each photoconductor were initially set to −750 V and −200 V, respectively, and the developing bias was set to −500 V.

Under the circumstances of 20° C. and 52% RH, 8,000 copies (A4 landscape) were continuously made. The image qualities obtained at the initial stage and after making of 8,000 copies were visually evaluated.

The results are shown in TABLE 17.

TABLE 17

| | Initial Image Quality | Image Quality after Making of 8,000 Copies |
|---|---|---|
| Ex. 40 | good | good |
| Ex. 41 | good | slight decrease of image density (acceptable for practical use) |
| Ex. 42 | good | slight toner deposition on background (acceptable for practical use) |

As can be seen from the results shown in TABLE 17, the undercoat layer coating liquid, even if stored for 3 months, was usable for the fabrication of the photoconductor according to the method of the present invention. In this case, the obtained images were acceptable for practical use after the photoconductor was repeatedly used. Further, when the drying temperature for formation of the undercoat layer was set, for example, at 95, 115, and 185° C., the obtained photoconductors produced satisfactory images.

EXAMPLE 43

Preparation of Undercoat Layer Coating Liquid

A coating liquid for undercoat layer was prepared by the following method.

30 parts by weight of the methoxymethylated polyamide (Trademark "Fine Resin FR-301", made by Namariichi Co., Ltd.) with a methoxymethylation ratio of 20 mol %, and 50 parts by weight of a commercially available butylated melamine resin (Trademark "Super Beckamine G-821-60", made by Dainippon Ink & Chemicals, Incorporated) with a nonvolatile content of 60 wt. % were dissolved in a mixed solvent of 200 parts by weight of methanol, 50 parts by weight of n-butanol, and 250 parts by weight of methyl ethyl ketone. With the addition of 250 parts by weight of untreated titanium oxide particles (Trademark "CR-EL", made by Ishihara Sangyo Kaisha, Ltd.), the resultant mixture was dispersed in a ball mill for 72 hours. Thereafter, 60.0 parts by weight of a methanol solution of maleic acid (with a solid content of 10 wt. %) were added to the above-mentioned mixture, so that a coating liquid for undercoat layer was prepared.

EXAMPLES 44 TO 48

Preparation of Undercoat Layer Coating Liquid

The procedure for preparation of-the coating liquid for undercoat layer as in Example 43 was repeated except that the maleic acid used in Example 43 was replaced by each of the respective organic acids shown in TABLE 18.

Thus, a coating liquid for undercoat layer was prepared.

TABLE 18

| | Organic Acid | Amount (in the form of methanol solution) |
|---|---|---|
| Ex. 44 | oxalic acid | 48 parts by weight |
| Ex. 45 | glycolic acid | 36 parts by weight |
| Ex. 46 | itaconic acid | 24 parts by weight |
| Ex. 47 | tartaric acid | 12 parts by weight |
| Ex. 48 | malonic acid | 6 parts by weight |

The dispersion stability of each of the undercoat layer coating liquids prepared in Examples 43 to 48 was evaluated by the following method. The particle size distribution of each coating liquid was analyzed to obtain the content of coarse particles with a particle size of 1.0 $\mu$m or more using a commercially available analyzer (Trademark "CAPA-700", made by Shimadzu Corporation) immediately after the preparation of the coating liquid. After the coating liquid was stored for one month with stirring with a stirrer, the content of the coarse particles in each coating liquid was obtained in the same manner as mentioned above.

The results are shown in TABLE 19.

TABLE 19

| | Content of Coarse Particles in Coating Liquid | |
|---|---|---|
| | Immediately After Preparation of Coating Liquid | After Storage for 1 Month |
| Ex. 43 | 20% | 20% |
| Ex. 44 | 15% | 15% |
| Ex. 45 | 10% | 10% |
| Ex. 46 | 5% | 5% |
| Ex. 47 | 1% | 1% |
| Ex. 48 | 1% | 1% |

As can be seen from the results shown in TABLE 19, the dispersion stability of any of the coating liquids was not caused to deteriorate even after one-month storage. It is considered that this is because the mixed solvent of an alcohol and a ketone is used for the preparation of the coating liquid in combination with the acid catalyst.

EXAMPLE 49

Preparation of Electrophotographic Photoconductor (Formation of undercoat layer)

There were prepared in Example 43 two kinds of coating liquids for undercoat layer, that is, the dispersions immediately after prepared, and stored for one month with stirring. Each coating liquid was coated on the outer surface of an aluminum drum with a diameter of 30 mm and a length of 340 mm, and dried at 120° C. for 20 minutes.

Thus, an undercoat layer with a thickness of 5.0 μm was provided on the aluminum drum.

[Formation of charge generation layer]

18 parts by weight of an A-type titanyl phthalocyanine pigment were placed in a glass pot together with zirconia beads with a diameter of 2 mm. With the addition of 350 parts by weight of methyl ethyl ketone, the above-mentioned mixture was subjected to ball milling for 15 hours. Thereafter, a resin solution prepared by dissolving 10 parts by weight of a commercially available polyvinyl butyral resin (Trademark "S-Lec BX-1", made by Sekisui Chemical Co., Ltd.) in 600 parts by weight of methyl ethyl ketone was added to the above mixture, and the resultant mixture was dispersed in a ball mill for 2 hours. Thus, a coating liquid for charge generation layer was prepared.

The coating liquid thus prepared was coated on the undercoat layer by dip coating, dried at 80° C. for 20 minutes, so that a charge generation layer with a thickness of about 0.3 μm was provided on the undercoat layer.

[Formation of charge transport layer]

The following components were mixed to prepare a coating liquid for charge transport layer:

| | Parts by Weight |
|---|---|
| Charge transport material of formula (23) | 9.0 |
| Polycarbonate resin (Trademark "Panlite C-1400", made by Teijin Chemicals Ltd.) | 10.0 |
| Silicone oil (Trademark "KF-50", made by Shin-Etsu Chemical Co., Ltd.) | 0.002 |
| Tetrahydrofuran | 30 |

The coating liquid thus prepared was coated on the charge generation layer by dip coating, and dried at 130° C. for 20 minutes, so that a charge transport layer with a thickness of 28 μm was provided on the charge generation layer.

Thus, two kinds of electrophotographic photoconductors 50*a* and 50*b* according to the present invention were obtained. The photoconductor 50*a* employed as the undercoat layer coating liquid the dispersion immediately after prepared in Example 43; while the photoconductor 50*b* employed as the undercoat layer coating liquid the dispersion stored for one month.

EXAMPLES 50 TO 54

The procedure for preparation of the two kinds of electrophotographic photoconductors 49*a* and 49*b* as in Example 49 was repeated except that the two kinds of coating liquids for undercoat layer prepared in Example 43 were replaced by those prepared in each of Examples 44 to 48.

Thus, two kinds of electrophotographic photoconductors according to the present invention were obtained in each Example.

<Image Formation Test>

Each of the electrophotographic photoconductors fabricated in Examples 50 to 54 was placed in a commercially available copying machine (Trademark "IMAGIO MF-200", made by Ricoh Company, Ltd.) where a contact type charger in the form of a roller and reversal development system were adapted.

The initial image quality and the image quality obtained after making of 2,500 copies under the circumstances of 20° C. and 52% RH were visually evaluated. The surface potentials (VD) and (VL) of each photoconductor were initially set to −950 V and −200 V, respectively, and the developing bias was set to −600 V.

The results are shown in TABLE 20.

TABLE 20

| | Photo-conductor No. | Initial Image Quality | Image Quality after Making of 2,500 Copies |
|---|---|---|---|
| Ex. 50 | 50a | good | good |
| | 50b | good | good |
| Ex. 51 | 51a | good | good |
| | 51b | good | good |
| Ex. 52 | 52a | good | good |
| | 52b | good | good |
| Ex. 53 | 53a | good | good |
| | 53b | good | good |
| Ex. 54 | 54a | good | good |
| | 54b | good | good |

As shown in TABLE 20, when any of the undercoat layer coating liquids prepared in Examples 43 to 48 was used to fabricate the photoconductor, excellent image quality was obtained after the photoconductor was repeatedly used. In other words, according to the method for producing the photoconductor of the present invention, even though the undercoat layer coating liquid is used after stored for one month, the obtained photoconductor can produce high image quality.

EXAMPLE 55

Preparation of Undercoat Layer Coating Liquid

A coating liquid for undercoat layer was prepared by the following method.

60 parts by weight of copolymer polyamide (Trademark "Amilan CM4000", made by Toray Industries, Inc.) were dissolved in 100 parts by weight of formic acid. The above prepared polyamide resin solution was stirred at 600° C. 60 parts by weight of paraformaldehyde were dissolved in 100 parts by weight of methanol with the addition thereto of an alkali, and the resultant methanol solution was gradually added to the above-mentioned polyamide resin solution with the temperature thereof being maintained at 60° C. The resultant mixture was stirred for 10 minutes. With further addition of 60 parts by weight of methanol, the mixture was stirred at 60° C. for 20 minutes.

The reaction mixture thus prepared was poured into 1500 ml of a mixed solvent of acetone and water at a mixing ratio by volume of 1:1. The mixture was neutralized by adding a 30% ammonia water dropwise thereto. The precipitated product was washed with water, so that a polyamide with a methoxymethylation ratio of 35 mol % was obtained.

45 parts by weight of the methoxymethylated polyamide thus obtained and 25 parts by weight of a commercially available butylated melamine resin (Trademark "Super Beckamine L-110-60", made by Dainippon Ink & Chemicals, Incorporated) with a nonvolatile content of 60 wt. % were dissolved in a mixed solvent of 300 parts by weight of methanol and 150 parts by weight of methyl ethyl ketone. With the addition of 330 parts by weight of untreated titanium oxide particles (Trademark "TA-300", made by Fuji Titanium Industry Co., Ltd.), the resultant mixture was dispersed in a ball mill for 100 hours. Thereafter, 22 parts by weight of a methanol solution of tartaric acid (with a solid content of 10 wt. %) were added to the above-mentioned mixture, so that a coating liquid for undercoat layer was prepared.

The methoxymethylation ratio of the above-mentioned methoxymethylated polyamide resin was obtained in the same manner as in Example 32.

EXAMPLE 56

Preparation of Undercoat Layer Coating Liquid

The procedure for preparation of the coating liquid for undercoat layer as in Example 55 was repeated except that the methoxymethylation ratio of the polyamide in Example 55 was changed from 35 to 10 mol % by controlling the modifying conditions.

Thus, a coating liquid for undercoat layer was prepared.

EXAMPLE 57

Preparation of Undercoat Layer Coating Liquid

The procedure for preparation of the coating liquid for undercoat layer as in Example 55 was repeated except that the methoxymethylation ratio of the polyamide in Example 55 was changed from 35 to 15 mol % by controlling the modifying conditions.

Thus, a coating liquid for undercoat layer was prepared.

EXAMPLE 58

Preparation of Undercoat Layer Coating Liquid

The procedure for preparation of the coating liquid for undercoat layer as in Example 55 was repeated except that the commercially available butylated melamine resin (Trademark "Super Beckamine L-110-60", made by Dainippon Ink & Chemicals, Incorporated) used in Example 55 was replaced by the commercially available methylated melamine resin (Trademark "Super Beckamine L-105-60", made by Dainippon Ink & Chemicals, Incorporated) with a nonvolatile content of 60 wt. %.

Thus, a coating liquid for undercoat layer was prepared.

The dispersion stability of each of the undercoat layer coating liquids prepared in Examples 55 to 58 was evaluated by the following method. The particle size distribution of each coating liquid was analyzed to obtain the content of coarse particles with a particle size of 1.0 $\mu$m or more, using a commercially available analyzer (Trademark "CAPA-700", made by Shimadzu Corporation) immediately after the preparation of each coating liquid. After the coating liquid was stored for 1.5 months with stirring with a stirrer, the content of the coarse particles was obtained in the same manner as mentioned above.

The results are shown in TABLE 21.

TABLE 21

| | Content of Coarse Particles in Coating Liquid | |
|---|---|---|
| | Immediately After Preparation of Coating Liquid | After Storage for 1.5 Months |
| Ex. 55 | 4% | 6% |
| Ex. 56 | 10% | 25% |
| Ex. 57 | 7% | 10% |
| Ex. 53 | 4% | 25% |

As can be seen from the results shown in TABLE 21, drastic deterioration of the dispersion stability was not observed after storage of 1.5 months with respect to the coating liquids prepared in Examples 55 to 58. It is confirmed that the coating liquid for undercoat layer used for the fabrication of the electrophotographic photoconductor is excellent in terms of the dispersion stability.

EXAMPLE 59

Preparation of Electrophotographic Photoconductor (Formation of undercoat layer)

There were prepared in Example 55 two kinds of coating liquids for undercoat layer, that is, the dispersions immediately after prepared, and stored for 1.5 months with stirring. Each coating liquid was coated on the outer surface of an aluminum drum with a diameter of 80 mm and a length of 360 mm, and dried at 110° C. for 30 minutes.

Thus, an undercoat layer with a thickness of 3.5 $\mu$m was provided on the aluminum drum.

[Formation of charge generation layer]

4 parts by weight of a commercially available butyral resin (Trademark "S-Lec BMS", made by Sekisui Chemical Co., Ltd.) were dissolved in 150 parts by weight of cyclohexanone. 16 parts by weight of the above-mentioned trisazo pigment of formula (22) were added to the above prepared butyral resin solution, and the resultant mixture was dispersed in a ball mill for 72 hours.

With the addition of 210 parts by weight of cyclohexanone, dispersing operation was further continued for 5 hours. Then, the mixture was diluted with cyclohexanone to have a solid content of 1.0 wt. % with stirring, so that a coating liquid for charge generation layer was prepared.

The coating liquid thus prepared was coated on the undercoat layer by dip coating, dried at 120° C. for 10 minutes, so that a charge generation layer with a thickness of about 0.3 $\mu$m was provided on the undercoat layer.

[Formation of charge transport layer]

The following components were mixed to prepare a coating liquid for charge transport layer:

| | Parts by Weight |
|---|---|
| Charge transport material of formula (23) | 9.5 |
| Polycarbonate resin (Trademark "Panlite TS-2050", made by Teijin Chemicals Ltd.) | 10 |
| Silicone oil (Trademark "KF-50", made by Shin-Etsu Chemical Co., Ltd.) | 0.002 |
| Tetrahydrofuran | 85 |

The coating liquid thus prepared was coated on the charge generation layer by dip coating, and dried at 130° C. for 20 minutes, so that a charge transport layer with a thickness of 30 $\mu$m was provided on the charge generation layer.

Thus, two kinds of electrophotographic photoconductors 59*a* and 59*b* according to the present invention were obtained. The photoconductor 59*a* employed as the undercoat layer coating liquid the dispersion immediately after prepared in Example 55; while the photoconductor 59*b* employed as the undercoat layer coating liquid the dispersion stored for 1.5 months.

EXAMPLES 60 TO 62

The procedure for preparation of the two kinds of electrophotographic photoconductors 59*a* and 59*b* as in Example 59 was repeated except that the two kinds of coating liquids for undercoat layer prepared in Example 55 were replaced by those prepared in each of Examples 56 to 58.

Thus, two kinds of electrophotographic photoconductors according to the present invention were obtained in each Example.

<Image Formation Test>

Each of the electrophotographic photoconductors fabricated in Examples 59 to 62 was placed in a commercially available copying machine (Trademark "IMAGIO 420V", made by Ricoh Company, Ltd.) which was modified as shown below.

Charging method: contact charging by use of a roller

Initial VD: −600 V

Initial VL: −150 V

Developing bias: −400 V

Developing method: reversal development

Under the circumstances of 20° C. and 52% RH, 3,000 copies were continuously made. The image qualities obtained at the initial stage and after making of 3,000 copies were visually evaluated.

The results are shown in TABLE 22.

TABLE 22

| | Photo-conductor No. | Initial Image Quality | Image Quality after Making of 3,000 Copies |
|---|---|---|---|
| Ex. 59 | 59a | good | good |
| | 59b | good | good |
| Ex. 60 | 60a | good | good |
| | 60b | slightly poor graininess (acceptable for practical use) | slightly poor graininess (acceptable for practical use) |
| Ex. 61 | 61a | good | good |
| | 61b | good | good |
| Ex. 62 | 62a | good | good |
| | 62b | slightly poor graininess (acceptable for practical use) | slightly poor graininess (acceptable for practical use) |

When any of the undercoat layer coating liquids prepared in Examples 55 to 58 was used to fabricate the photoconductor, image quality obtained after making of copies was satisfactory as shown in TABLE 22. In other words, according to the method for producing the photoconductor of the present invention, the undercoat layer coating liquid can be used even after a long-term storage.

EXAMPLE 63

The procedure for preparation of the electrophotographic photoconductor No. 40 as in Example 40 was repeated except that the thickness of the charge transport layer employed in Example 40 was changed from 29 to 26 $\mu$m.

Thus, an electrophotographic photoconductor No. 63 according to the present invention was obtained.

EXAMPLE 64

The procedure for preparation of the electrophotographic photoconductor No. 63 as in Example 63 was repeated except that the drying temperature for formation of the undercoat layer in Example 63 was changed from 115 to 95° C.

Thus, an electrophotographic photoconductor No. 64 according to the present invention was obtained.

EXAMPLE 65

The procedure for preparation of the electrophotographic photoconductor No. 63 as in Example 63 was repeated except that the drying temperature for formation of the undercoat layer in Example 63 was changed from 115 to 185° C.

Thus, an electrophotographic photoconductor No. 65 according to the present invention was obtained.

<Image Formation Test>

Each of the electrophotographic photoconductors No. 63 to No. 65 respectively fabricated in Examples 63 to 65 was placed in a commercially available copying machine (Trademark "IMAGIO MF-2200", made by Ricoh Company, Ltd.) where a contact type charger in the form of a roller and reversal development system were adapted.

The surface potentials (VD) and (VL) of each photoconductor were initially set to −850 V and −200 V, respectively, and the developing bias was set to −500 V.

Under the circumstances of 20° C. and 52% RH, 10,000 copies (A4 landscape) were continuously made. The image qualities obtained at the initial stage and after making of 10,000 copies were visually evaluated.

The results are shown in TABLE 23.

TABLE 23

| | Initial Image Quality | Image Quality after Making of 10,000 copies |
|---|---|---|
| Ex. 63 | good | good |
| Ex. 64 | good | slight decrease of image density (acceptable for practical use) |
| Ex. 65 | good | slight toner deposition on background (acceptable for practical use) |

As can be seen from the results shown in TABLE 23, when the undercoat layer coating liquid was used for the fabrication of the photoconductor after the storage for 3 months, the images were also satisfactory even after the photoconductor was repeatedly used. Further, when the drying temperature for formation of the undercoat layer was changed to 95, 115, and 185° C., the obtained images were acceptable for practical use in any case.

As previously explained, the electrophotographic photoconductor of the present invention is less dependent upon the environmental conditions. When such a photoconductor is installed in an image forming apparatus, high quality images can be produced even though the photoconductor is repeatedly used under the circumstances of high temperature and humidity and low temperature and humidity.

Further, even when the thickness of the undercoat layer is increased, the rise of residual potential can be inhibited, and the deterioration of the photoconductor can be minimized even though the photoconductor is repeatedly used for an extended period of time. Namely, since the undercoat layer for use in the photoconductor of the present invention can be thickened, it is possible to minimize the occurrence of abnormal images caused by the discharge breakdown of the thin undercoat layer when the contact type charger is used as the charging means in the image forming apparatus. In addition to the above, scratches and surface roughness of the electroconductive support can be completely hidden by increasing the thickness of the undercoat layer provided on the electroconductive support. This makes it possible to omit the step of regulating the surface of the electroconductive support in the course of fabrication of the photoconductor. Consequently, the manufacturing cost of the photoconductor can be curtailed. Furthermore, the mechanical strength of the photoconductor of the present invention is excellent.

According to the method of producing the photoconductor of the present invention, crosslinking of the N-alkoxymethylated polyamide or the mixture of the N-alkoxymethylated polyamide and the melamine resin for use in the undercoat layer is firmly conducted, the environmental stability of the obtained photoconductor can be improved. Therefore, high quality images can be obtained even when the photoconductor is repeatedly used under the circumstances of high temperature and humidity, or low temperature and humidity. Furthermore, the dispersion stability of the undercoat layer coating liquid can be improved, so that the photoconductor can be fabricated without frequent replacement of the undercoat layer coating liquid. This can curtail the time required for produce the photoconductor, and reduce the manufacturing cost at the same time.

The electrophotographic image forming apparatus, process cartridge, and electrophotographic process according to the present invention employ the above-mentioned electrophotographic photoconductor, so that high quality images can be provided even after the photoconductor is repeatedly used under the circumstances of high temperature and humidity or low temperature and humidity.

Japanese Patent Application No. 11-223210 filed Aug. 6, 1999, Japanese Patent Application No. 11-333108 filed Nov. 24, 1999, and Japanese Patent Application No. 2000-113299 filed Apr. 14, 2000 are hereby incorporated by reference.

What is claimed is:

1. An electrophotographic photoconductor comprising:

an electroconductive support, an undercoat layer formed thereon, and a photoconductive layer formed on said undercoat layer, said undercoat layer comprising (a) an inorganic pigment and (b) a binder resin which is selected from the group consisting of a crosslinked N-alkoxymethylated polyamide and a crosslinked material of an N-alkoxymethylated polyamide and a melamine resin.

2. The electrophotographic photoconductor as claimed in claim 1, wherein said undercoat layer comprises:

a first undercoat layer provided on said electroconductive support comprising a thermosetting resin and said inorganic pigment dispersed in said thermosetting resin, and a second undercoat layer provided on said first undercoat layer comprising said binder resin selected from the group consisting of said crosslinked N-alkoxymethylated polyamide and said crosslinked material of said N-alkoxymethylated polyamide and said melamine resin.

3. The electrophotographic photoconductor as claimed in claim 1, wherein said inorganic pigment comprises at least one selected from the group consisting of titanium oxide and aluminum oxide.

4. The electrophotographic photoconductor as claimed in claim 3, wherein said titanium oxide is untreated.

5. The electrophotographic photoconductor as claimed in claim 4, wherein said titanium oxide has a purity of 99.5 wt. % or more.

6. The electrophotographic photoconductor as claimed in claim 1, wherein said N-alkoxymethylated polyamide has an N-alkoxymethylation ratio of 15 mol % or more.

7. The electrophotographic photoconductor as claimed in claim 1, wherein said N-alkoxymethylated polyamide comprises methoxymethylated polyamide.

8. The electrophotographic photoconductor as claimed in claim 1, wherein said melamine resin comprises butylated melamine resin.

9. The electrophotographic photoconductor as claimed in claim 2, wherein said second undercoat layer has a thickness of 0.01 to 1 $\mu$m.

10. A method for producing an electrophotographic photoconductor comprising the steps of:

applying a coating liquid for undercoat layer comprising an inorganic pigment and a binder resin which is selected from the group consisting of an N-alkoxymethylated polyamide and a mixture of an N-alkoxymethylated polyamide and a melamine resin to an electroconductive support to form a coated film thereon, heating said coated film to crosslink said N-alkoxymethylated polyamide or said mixture of N-alkoxymethylated polyamide and melamine resin, thereby providing an undercoat layer on said electroconductive support, and providing a photoconductive layer on said undercoat layer.

11. A method for producing an electrophotographic photoconductor comprising the steps of:

providing on an electroconductive support a first undercoat layer which comprises a thermosetting resin and an inorganic pigment dispersed in said thermosetting resin, applying a coating liquid for second undercoat layer comprising a binder resin which is selected from the group consisting of an N-alkoxymethylated polyamide and a mixture of an N-alkoxymethylated polyamide and a melamine resin to said first undercoat layer to form a coated film thereon, heating said coated film to crosslink said N-alkoxymethylated polyamide or said mixture of N-alkoxymethylated polyamide and melamine resin, thereby providing a second undercoat layer on said first undercoat layer, and providing a photoconductive layer on said second undercoat layer.

12. The method for producing said electrophotographic photoconductor as claimed in claim 10, wherein said coated film is heated at temperature in a range of 85 to 185° C. to provide said undercoat layer.

13. The method for producing said electrophotographic photoconductor as claimed in claim 11, wherein said coated film is heated at temperature in a range of 85 to 185° C. to provide said second undercoat layer.

14. The method for producing said electrophotographic photoconductor as claimed in claim 10, wherein said coating liquid for undercoat layer further comprises an acid catalyst.

15. The method for producing said electrophotographic photoconductor as claimed in claim 11, wherein said coating liquid for second undercoat layer further comprises an acid catalyst.

16. The method for producing said electrophotographic photoconductor as claimed in claim 14, wherein said acid catalyst is an inorganic acid, and said coating liquid for undercoat layer further comprises a mixed solvent of an alcohol and a ketone.

17. The method for producing said electrophotographic photoconductor as claimed in claim 15, wherein said acid catalyst is an inorganic acid, and said coating liquid for second undercoat layer further comprises a mixed solvent of an alcohol and a ketone.

18. The method for producing said electrophotographic photoconductor as claimed in claim 14, wherein said acid catalyst is an organic acid, and said coating liquid for undercoat layer further comprises a mixed solvent of an alcohol and a ketone.

19. The method for producing said electrophotographic photoconductor as claimed in claim 15, wherein said acid catalyst is an organic acid, and said coating liquid for second undercoat layer further comprises a mixed solvent of an alcohol and a ketone.

20. An electrophotographic image forming apparatus comprising:

an electrophotographic photoconductor, means for charging said electrophotographic photoconductor to form a latent electrostatic image thereon, and means for developing said latent electrostatic image formed on said electrophotographic photoconductor to a visible image, wherein said electrophotographic photoconductor comprises:

an electroconductive support, an undercoat layer formed thereon, and a photoconductive layer formed on said undercoat layer, said undercoat layer comprising (a) an inorganic pigment and (b) a binder resin which is selected from the group consisting of a crosslinked N-alkoxymethylated polyamide and a crosslinked material of an N-alkoxymethylated polyamide and a melamine resin.

21. The electrophotographic image forming apparatus as claimed in claim 20, wherein said charging means employs a contact charging method.

22. The electrophotographic image forming apparatus as claimed in claim 20, wherein said undercoat layer for use in said electrophotographic photoconductor comprises:

a first undercoat layer provided on said electroconductive support comprising a thermosetting resin and said inorganic pigment dispersed in said thermosetting resin, and a second undercoat layer provided on said first undercoat layer comprising said binder resin selected from the group consisting of said crosslinked N-alkoxymethylated polyamide and said crosslinked material of said N-alkoxymethylated polyamide and said melamine resin.

23. The electrophotographic image forming apparatus as claimed in claim 22, wherein said charging means employs a contact charging method.

24. An electrophotographic image forming apparatus comprising:

an electrophotographic photoconductor, a charging unit configured to charge said electrophotographic photoconductor, thereby forming a latent electrostatic image thereon, and a developing unit configured to develop said latent electrostatic image formed on said electrophotographic photoconductor to a visible image, wherein said electrophotographic photoconductor comprises:

an electroconductive support, an undercoat layer formed thereon, and a photoconductive layer formed on said undercoat layer, said undercoat layer comprising (a) an inorganic pigment and (b) a binder resin which is selected from the group consisting of a crosslinked N-alkoxymethylated polyamide and a crosslinked material of an N-alkoxymethylated polyamide and a melamine resin.

25. The electrophotographic image forming apparatus as claimed in claim 24, wherein said charging unit employs a contact charging method.

26. The electrophotographic image forming apparatus as claimed in claim 24, wherein said undercoat layer for use in said electrophotographic photoconductor comprises:

a first undercoat layer provided on said electroconductive support comprising a thermosetting resin and said inorganic pigment dispersed in said thermosetting resin, and a second undercoat layer provided on said first undercoat layer comprising said binder resin selected from the group consisting of said crosslinked N-alkoxymethylated polyamide and said crosslinked material of said N-alkoxymethylated polyamide and said melamine resin.

27. The electrophotographic image forming apparatus as claimed in claim 26, wherein said charging unit employs a contact charging method.

28. A process cartridge which is freely attachable to an electrophotographic image forming apparatus and detachable therefrom, said process cartridge comprising an electrophotographic photoconductor, and at least one means selected from the group consisting of a charging means for charging the surface of said photoconductor, a light exposure means for exposing said photoconductor to a light image to form a latent electrostatic image on said photoconductor, a developing means for developing said latent electrostatic image to a visible image, and an image transfer means for transferring said visible image formed on said photoconductor to an image receiving member, wherein said electrophotographic photoconductor comprises:

an electroconductive support, an undercoat layer formed thereon, and a photoconductive layer formed on said undercoat layer, said undercoat layer comprising (a) an inorganic pigment and (b) a binder resin which is selected from the group consisting of a crosslinked N-alkoxymethylated polyamide and a crosslinked material of an N-alkoxymethylated polyamide and a melamine resin.

29. The process cartridge as claimed in claim 28, wherein said undercoat layer for use in said electrophotographic photoconductor comprises:

a first undercoat layer provided on said electroconductive support comprising a thermosetting resin and said inorganic pigment dispersed in said thermosetting resin, and a second undercoat layer provided on said first undercoat layer comprising said binder resin selected from the group consisting of said crosslinked N-alkoxymethylated polyamide and said crosslinked material of said N-alkoxymethylated polyamide and said melamine resin.

30. A process cartridge which is freely attachable to an electrophotographic image forming apparatus and detachable therefrom, said process cartridge comprising an electrophotographic photoconductor, and at least one unit selected from the group consisting of a charging unit configured to charge the surface of said photoconductor, a light exposure unit configured to expose said photoconductor to a light image so as to form a latent electrostatic image on said photoconductor, a developing unit configured to develop said latent electrostatic image to a visible image, and an image transfer unit configured to transfer said visible image formed on said photoconductor to an image receiving member, wherein said electrophotographic photoconductor comprises:

an electroconductive support, an undercoat layer formed thereon, and a photoconductive layer formed on said undercoat layer, said undercoat layer comprising (a) an inorganic pigment and (b) a binder resin which is selected from the group consisting of a crosslinked N-alkoxymethylated polyamide and a crosslinked material of an N-alkoxymethylated polyamide and a melamine resin.

31. The process cartridge as claimed in claim 30, wherein said undercoat layer for use in said electrophotographic photoconductor comprises:

a first undercoat layer provided on said electroconductive support comprising a thermosetting resin and said inorganic pigment dispersed in said thermosetting resin, and a second undercoat layer provided on said first undercoat layer comprising said binder resin selected from the group consisting of said crosslinked N-alkoxymethylated polyamide and said crosslinked material of said N-alkoxymethylated polyamide and said melamine resin.

32. An electrophotographic image forming process comprising the steps of:

forming a latent electrostatic image on the surface of an electrophotographic photoconductor, and developing said latent electrostatic image to a visible image by reversal development, wherein said electrophotographic photoconductor comprises:

an electroconductive support, an undercoat layer formed thereon, and a photoconductive layer formed on said undercoat layer, said undercoat layer comprising (a) an inorganic pigment and (b) a binder resin which is selected from the group consisting of a crosslinked N-alkoxymethylated polyamide and a crosslinked material of an N-alkoxymethylated polyamide and a melamine resin.

33. The electrophotographic image forming process as claimed in claim 32, wherein said undercoat layer for use in said electrophotographic photoconductor comprises:

a first undercoat layer provided on said electroconductive support comprising a thermosetting resin and said inorganic pigment dispersed in said thermosetting resin, and a second undercoat layer provided on said first undercoat layer comprising said binder resin selected from the group consisting of said crosslinked N-alkoxymethylated polyamide and said crosslinked material of said N-alkoxymethylated polyamide and said melamine resin.

* * * * *

UNITED STATES PATENT AND TRADEMARK OFFICE

CERTIFICATE OF CORRECTION

PATENT NO. : 6,355,390 B1
DATED : March 12, 2002
INVENTOR(S) : Hirofumi Yamanami et al.

It is certified that error appears in the above-identified patent and that said Letters Patent is hereby corrected as shown below:

Column 3,
Line 5, delete “.”

Column 6,
Line 33, delete second “a”

Column 11,
Line 64, make “P” in “Prepared” lowercase

Column 14,
Line 35, insert -- layer 2 -- between “undercoat” and “(or”

Column 18,
Line 1, delete “’” in “amine’”

Column 20,
Line 61, insert -- HO-X-OH (5) --

Column 21,
Line 11, delete “.” in “.aliphatic”

Column 22,
Line 8, insert -- $SO_2$,- -- between “-SO-,” and “-CO-,”

Column 23,
Line 60, insert -- HO-X-OH (5) --

Column 24,
Line 5, move “[Polycarbonate of formula (14)]” to line 6 entirely
Line 66, delete “-$R^{112}$” and insert in its place -- -$OR^{112}$ --

Column 25,
Line 52, insert -- HO-X-OH (5) --

Column 26,
Line 37, delete “-” between “and” and “arylene”
Line 56, insert -- HO-X-OH (5) --

UNITED STATES PATENT AND TRADEMARK OFFICE

CERTIFICATE OF CORRECTION

PATENT NO. : 6,355,390 B1
DATED : March 12, 2002
INVENTOR(S) : Hirofumi Yamanami et al.

It is certified that error appears in the above-identified patent and that said Letters Patent is hereby corrected as shown below:

Column 28,
Line 16, insert -- HO-X-OH (5) --

Column 29,
Line 25, insert -- HO-X-OH (5) --

Column 30,
Line 16, delete "is"
Line 32, delete first "may"

Column 46,
Line 21, delete "850º" and insert in its place -- 85º --
Line 65, place "EXAMPLE 15" on line 63 with a period behind "15" and make all letters except first "E" lower case Column 48,
Line 11, insert -- (non-light exposed portion" between "portion" and ")(VD) --

Column 52,
Lines 45 and 61, delete "50,0000" and insert in its place -- 12,000 --

Column 53,
Line 5, delete "50,000" and insert in its place -- 12,000 --

Column 57,
Line 54, delete "good decrease of image density" beside "Ex. 16"

Column 66,
Line 12, delete "-"

Column 67,
Line 35, delete "30" and insert in its place -- 80 --

UNITED STATES PATENT AND TRADEMARK OFFICE

CERTIFICATE OF CORRECTION

PATENT NO. : 6,355,390 B1 
DATED : March 12, 2002
INVENTOR(S) : Hirofumi Yamanami et al.

It is certified that error appears in the above-identified patent and that said Letters Patent is hereby corrected as shown below:

Column 69,
Line 60, delete "53" and insert in its place -- 58 --

Signed and Sealed this

Twenty-fourth Day of September, 2002

*Attest:*

*Attesting Officer*

JAMES E. ROGAN
*Director of the United States Patent and Trademark Office*